US007188564B2

(12) United States Patent
Ashikagaya

(10) Patent No.: US 7,188,564 B2
(45) Date of Patent: Mar. 13, 2007

(54) STENCIL PRINTER WITH A DUPLEX PRINTING CAPABILITY

(75) Inventor: Atsushi Ashikagaya, Miyagi (JP)

(73) Assignee: Tohoku Ricoh Co., Ltd., Miyagi (JP)

( * ) Notice: Subject to any disclaimer, the term of this patent is extended or adjusted under 35 U.S.C. 154(b) by 339 days.

(21) Appl. No.: 10/799,858

(22) Filed: Mar. 15, 2004

(65) Prior Publication Data

US 2006/0144263 A1 Jul. 6, 2006

(30) Foreign Application Priority Data

Jun. 30, 2003 (JP) ..... 2003-188089

(51) Int. Cl.
*B41L 13/04* (2006.01)

(52) U.S. Cl. ..... 101/118; 101/116; 101/231

(58) Field of Classification Search ..... 101/116, 101/117, 118, 129, 484, 229, 231, 232, 119, 101/120, 490
See application file for complete search history.

(56) References Cited

U.S. PATENT DOCUMENTS 6,718,872 B2 * 4/2004 Kanno ..... 101/118

FOREIGN PATENT DOCUMENTS

JP 6-71996 3/1994
JP 6-135111 5/1994
JP 8-90893 4/1996
JP 8-142477 6/1996
JP 8-332768 12/1996
JP 2003-200645 7/2003

* cited by examiner

*Primary Examiner*—Ren Yan
(74) *Attorney, Agent, or Firm*—Oblon, Spivak, McClelland, Maier & Neustadt, P.C.

(57) ABSTRACT

Disclosed is a duplex printer which is capable of performing simplex printing without wasting a master and providing a print output with a satisfactory image quality at the time of duplex printing, and which is capable of suppressing an increase in installation space while effecting adjustment on the print image position in the sheet conveyance direction. The duplex printer includes a printing section, a sheet feeding section, a sheet discharging section, an auxiliary tray, refeeding means for refeeding a sheet having an image printed on its front side, and a path selector that steers the sheet to one of the auxiliary tray and the sheet discharging section. In a duplex printing mode, a master having first and second perforated images formed thereon side by side is wound around a print drum, thereby performing duplex printing. The position of each print image with respect to the sheet in the sheet conveyance direction is adjusted by changing the timing with which the sheet is fed from the sheet feeding section to the printing section, and the timing with which the sheet is refed from the refeeding means to the printing section.

10 Claims, 13 Drawing Sheets

STENCIL PRINTER WITH A DUPLEX PRINTING CAPABILITY

BACKGROUND OF THE INVENTION

1. Field of the Invention

The present invention relates to a printer with a duplex printing capability (hereinafter simply referred to as the "duplex printer"), and more specifically to a stencil printer capable of printing images on both sides of a sheet in a single step.

2. Description of the Background Art

A digital thermal printing system using a stencil is used as a simple, convenient printer. A stencil printer used in such a digital thermal printing system includes a thermal head provided with an array of minute heat-generating elements. While a master is being conveyed in contact with the thermal head, a current is selectively fed to the heat-generating elements in the form of pulses in accordance with image data, thereby perforating the master with heat. After the perforated stencil or master has been wrapped around a porous, cylindrical print drum, a press roller or similar pressing means is pressed against the print drum via a sheet. As a result, ink is transferred from the print drum to the sheet via the perforations of the master, printing an image on the sheet.

Today, duplex printing systems for printing images on both sides of a sheet are becoming widely adopted for such a stencil printer because they reduce the consumption of sheets, the space for storing of documents and so forth. With conventional stencil printers employing such duplex printing systems, it has been customary to execute duplex printing by passing a sheet fed from a sheet feeding section through a printing section to thereby print an image on one side of the sheet, reversing the sheet, and again passing the sheet through the printing section to thereby print another image on the other side of the sheet. However, it is troublesome to again set the sheet driven out at the sheet feeding section or to arrange consecutive sheets each carrying an image on one side thereof by hand. In addition, because sheets are fed to the printing section twice, duplex printing takes twice as much net time as simplex printing, making it too time-consuming.

In light of the above, for example, JP 6-71996 A (pages 3 to 5, FIG. 2) and JP 6-135111 A (pages 4 to 7, FIG. 1) each disclose a stencil printer including first and second print drums and moving means for selectively causing the two print drums into or out of contact with each other. The stencil printer produces a duplex print in a single step by causing the two print drums to contact with each other with the moving means.

Also, for example, JP 8-90893 A (pages 6 to 9, FIG. 1) and JP 8-142477 A (pages 4 and 5, FIG. 4) each propose a stencil printer including a first print drum, first pressing means facing the first print drum via a sheet path, a second print drum positioned downstream of the first print drum in a direction of sheet conveyance and facing the first print drum via a sheet path, and second pressing means facing the second print drum via a sheet path. To produce a duplex print in a single step, the first print drum and first pressing means and the second print drum and second pressing means are sequentially caused to contact each other in this order.

Further, for example, JP 8-332768 A (pages 14 to 20, FIG. 1) teaches a stencil printing method and a stencil printer for practicing the same. The stencil printing method taught in this document produces a duplex print in a single step, by using a master having first and second perforated images formed thereon side by side in the direction of rotation of a print drum. First, a press roller is rotated in direct contact with the print drum in synchronism with either one of the first and second perforated images, so that a first print image corresponding to the first or the second perforated image is transferred from the print drum to the outer peripheral surface of the press roller. Then, the press roller is rotated in contact with the print drum via a sheet with the other of the first and second perforated images being matched in position to the first print image present on the press roller. As a result, the first print image on the press roller is transferred to one side of the sheet while a second print image corresponding to the second image is transferred from the print drum to the other side of the sheet.

The prior art techniques disclosed in JP 6-71996 A, JP 6-135111 A, and the like stated above have the following problems left unsolved. That is, two print drums positioned one above the other are configured to be selectively brought into or out of contact with each other, even in a simplex print mode. In the simplex mode, a perforated master and a non-perforated master must be respectively wrapped around the two print drums, resulting in the wasteful consumption of the master. Further, the two print drums, which are selectively brought into or out of contact with each other each, each have a clamper mounted thereon for retaining the master. Thus, at a position where the clampers face each other, the print drums must be released from each other. This brings about a problem that when printing speed is high, the area over which the print drums contact each other, and therefore an image area, decreases. If the outer diameter of each print drum is increased to guarantee a sufficient image area, then not only the size reduction of the printer is obstructed, but also loud noise is produced when the print drums are brought into contact with each other.

Further, JP 8-90893 A and JP 8-142477 A mentioned above and the like also have the problem that a non-perforated master must be wrapped around one of the two print drums in a simplex print mode, resulting in the wasteful consumption of the master. Another problem is that because the two print drums are serially arranged, the printer is almost twice as large in size as a stencil printer for simplex printing. This is undesirable from the space saving standpoint.

Further, the problem with JP 8-332768 A mentioned above is that image density differs between the front side and the rear side of a sheet because one of the first and second perforated images is directly transferred from the print drum to a sheet while the other of the perforated images is transferred to the sheet by way of the press roller.

Technologies relating to the present invention are also disclosed in, e.g., JP 2003-200645 A.

SUMMARY OF THE INVENTION

It is an object of the present invention to provide a duplex printer which is capable of producing a simplex print in a simplex print mode without wasting a master and producing an attractive duplex print in a single step in a duplex print mode while occupying a minimum of space.

In accordance with the present invention, there is provided a duplex printer capable of switching between a simplex print mode and a duplex print mode. The duplex printer comprises a printing section including a print drum and a press roller. The press roller is movable into or out of contact with the print drum. The duplex printer further comprises a sheet feeding section for feeding a sheet toward the printing section, a sheet discharging section for discharging to an outside of the printer a printed sheet on which printing has been performed in the printing section, an auxiliary tray for temporarily retaining thereon a front-side-printed sheet having a print image formed on its front side in the printing section, refeeding means for refeeding the front-side-printed sheet retained on the auxiliary tray toward the printing section, and a path selector for steering the sheet coming out of the printing section to one of the auxiliary tray and the sheet discharging section. In the duplex print mode, a master having a first perforated image and a second perforated image formed thereon side by side, is wound around the print drum, and a first sheet is fed to the printing section from the sheet feeding section to print a first print image corresponding to the first perforated image on a front side of the first sheet, and after the first sheet having the first print image printed thereon is steered toward the auxiliary tray by the path selector, a second sheet is fed to the printing section from the sheet feeding section to print the first print image on a front side of the second sheet while the refeeding means feeds the first sheet to the printing section again to thereby print a second print image corresponding to the second perforated image on a reverse side of the first sheet, and the first sheet and the second sheet are steered by the path selector toward the sheet discharging section and the auxiliary tray, respectively. The duplex printer is capable of effecting position adjustment on each of the first and second print images with respect to each of the first and the second sheets in a sheet conveyance direction, with position adjustment on the first print image being effected by changing a sheet feeding timing of the sheet feeding section and position adjustment on the second print image being effected by changing a refeeding timing of the refeeding means.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
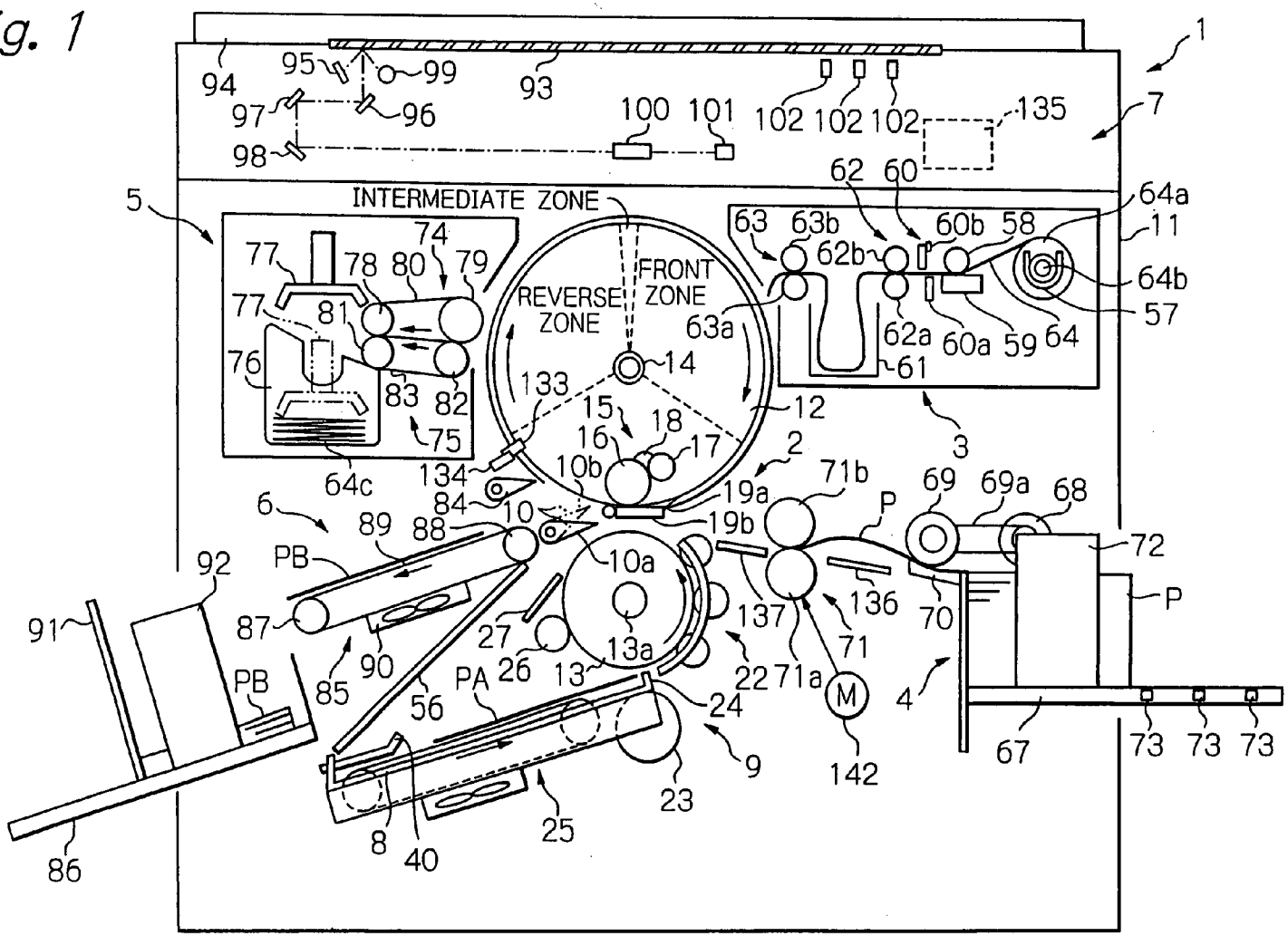
FIG. 1 is a front view showing a general construction of a duplex printer according to a first embodiment of the present invention.

Referring to FIG. 1 of the drawings, a duplex printer according to an embodiment of the present invention is shown. As shown in the figure, a duplex printer 1 includes a printing section 2, a master making section 3, a sheet feeding section 4, a master discharging section 5, a sheet discharging section 6, an image scanning section 7, an auxiliary tray 8, a refeeding section 9, a path selector 10, and the like.

The printing section 2 is arranged in and substantially at the center of a printer main body 11 and includes a print drum 12 and a press roller 13.

The print drum 12 includes a pair of end plates, a porous support plate, and a mesh screen (none of which are shown). The end plates are freely rotatably mounted on a shaft 14 that serves as an ink feed pipe at the same time. The porous support plate is wrapped around the circumferences of the end plates while the mesh screen is wrapped around the porous support plate. The print drum 12 is caused to rotate by drum drive means 121 (see FIG. 11) and bodily removable from the printer main body 11. In the illustrative embodiment, the print drum 12 is so sized as to produce a print of up to size A3 in a simplex print mode.

Ink feeding means 15 is arranged inside the print drum 12 and includes an ink roller 16 and a doctor roller 17 as well as the shaft 14.

The ink roller 16 is journalled to opposite side plates positioned in the print drum 12 and held in contact with the inner periphery of the print drum 12. Drive means (not shown) causes the ink roller 16 to rotate in the same direction as the print drum 12. The doctor roller 17 is also journalled to the above side plates and positioned such that its periphery adjoins the periphery of the ink roller 16. Drive means (not shown) causes the doctor roller 17 to rotate in opposite direction to the print drum 12. A plurality of small holes are formed in the shaft 14. In this configuration, ink fed to the inside of the shaft 14 drops through the holes and forms an ink well 18 in a wedge-shaped space between the ink roller 16 and the doctor roller 17.

A stage 19*a* is formed on the outer periphery of the print drum 12, the stage 19*a* constituting a plane extending along a generatrix of the print drum 12. A damper 19*b* is arranged on the stage for retaining the leading end of a master on the outer periphery of the print drum 12. When the print drum 12 is rotated to a predetermined angular position, opening/closing means (not shown) opens and closes the clamper 19*b*.

Figure 2:
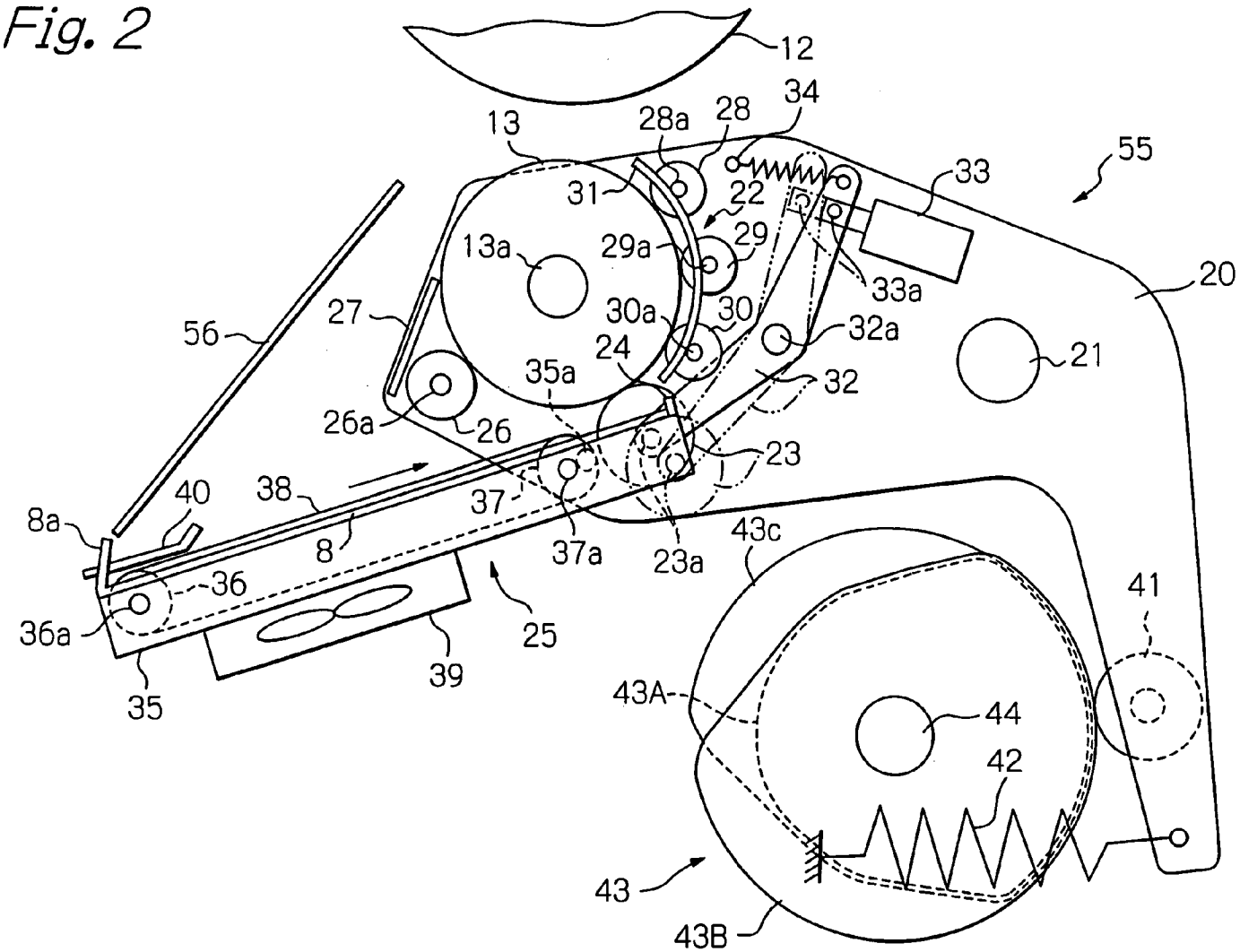
FIG. 2 is a front view showing a press roller in a position released from an outer peripheral surface of a print drum, and a construction of a main portion of refeeding means, which are used in the duplex printer.

The press roller 13 is positioned below the print drum 12 and extends in the axial direction of the print drum 12. The press roller 13 is made up of a metallic core 13*a* and an elastic layer formed of, e.g., rubber and wrapped around the core 13*a*. As shown in FIG. 2, a pair of arms 20 (only one is visible) rotatably support opposite ends of the core 13*a* of the press roller 13. The arms 20 having a substantially L-shaped configuration are interconnected by an angularly movable shaft 21 in the vicinity of their bent portions. The shaft 21 is journalled to the printer main body 11. In the illustrative embodiment, at least the surface of the press roller 13 is formed of polytetrafluoroethylene resin or similar ink-repellant material.

Also mounted on each arm 20 are refeed guide means 22, a refeed registration roller or member 23, a refeed positioning member 24, a refeed conveying member 25, a cleaning roller 26, and a guide plate 27.

The refeed guide means 22, adjoining the right side of the press roller 13, is made up of a plurality of segment rollers 28, 29 and 30, and a guide plate 31. The rollers 28, 29, and 30 each are mounted on one of shafts 28*a*, 29*a*, and 30*a* and pressed against the press roller 13. The guide plate 31 is so curved as to cause a sheet PA having an image printed on its front side (hereinafter this sheet is referred to as the "front-side-printed sheet") to move along the circumference of the press roller 13. The shafts 28*a* through 30*a* are journalled to the arms 20 at their opposite ends and constantly biased by biasing means (not shown) toward the core 13*a*. The rollers 28 through 30 extend over substantially the entire width of the press roller 13.

The guide plate 31 is spaced from the circumference of the press roller 13 by a predetermined distance smaller than the radius of each of the rollers 28 through 30 and is supported by the arms 20 at its opposite ends. The guide plate 31 has a curvature whose center is positioned at the axis of the core 13*a* and is formed with a plurality of openings, so that the rollers 28 through 30 can contact the press roller 13.

The refeed registration roller 23 is positioned below the press roller 13. The refeed registration roller, which consists of a plurality of segment rollers, is freely rotatably mounted on a shaft 23*a*, which is mounted between respective one ends of a pair of angularly movable arms 32. Each arm 32, which has a substantially chevron-like configuration, is angularly movably mounted on a shaft 32*a*, which is supported by the arms 20, at its bent portion. The arm 32 is so positioned as to avoid interference with each roller 30 upon angular movement.

A solenoid 33 is mounted on the other of the arms 20 via a bracket (not shown) and has a plunger 33*a* connected to the other end of one of the arms 32. A tension spring 34 is anchored at one end to one of the arms 20 and at the other end to the above end of the arm 32, constantly biasing the arm 32 counterclockwise, as viewed in FIG. 2, about the shaft 32*a*. When the solenoid 33 is energized, the refeed registration roller 23 is brought to a position indicated by a solid line in FIG. 2 where it is pressed against the press roller 13 by predetermined pressure. When the solenoid 33 is deenergized, the refeed registration roller 23 is brought to a position indicated by a two-dot chain line in FIG. 2 where it is released from the press roller 13 due to the biasing force of the tension spring 34.

The refeed conveying member 25 is positioned below the press roller 13 at the left-hand side of the refeed positioning member 24. The refeed conveying member 25 includes a conveying member main body 35, a drive roller 36, a driven roller 37, an endless belt 38 passed over the drive roller 36 and driven roller 37, and a suction fan 39. An auxiliary tray 8 is positioned above and constructed integrally with the refeed conveying member 25.

The main body 35 is open at its top and has a width slightly smaller than the distance between the arms 20. Bearings (not shown), are mounted on opposite side surfaces of the main body 35 at the upstream and downstream sides in the sheet conveyance direction thereof, rotatably supporting a driven shaft 36*a* and a driven shaft 37*a*. The drive shaft 36*a* extends throughout the side surfaces of the main body 35 and have its opposite ends rotatably supported by bearings (not shown) mounted on the printer main body 11. A drive gear (not shown) is mounted on one end of the drive shaft 36*a* and operatively connected to a conveyor drive motor 122 (see FIG. 11) mounted on the printer main body 11. The driven shaft 37*a* does not extend through the side surfaces of the main body 35.

A boss 35*a* is formed on each side wall of the main body 35 at the upstream side in the direction of sheet feed and movably received in a slot (not shown) formed in each arm 20. In this configuration, when a press roller moving mechanism 55, which will be described later, moves the press roller 13 into or out of contact with the print drum 12, the main body 35 is angularly movable about the drive shaft 36*a* in accordance with the movement of the arms 20.

The drive roller 36 mounted on the drive shaft 36*a* is implemented as a plurality of segment rollers spaced from each other by a predetermined distance. Likewise, the driven roller 37 integrally mounted on the driven shaft 37*a* is implemented as a plurality of segment rollers spaced from each other by the same distance as the segments of the drive roller 36. The belt 38 is passed over the drive roller 36 and driven roller 37 under predetermined tension. The conveyor drive motor 122 causes the belt 38 to move in a direction indicated by an arrow in FIG. 2 via the drive shaft 36*a*.

Figure 3:
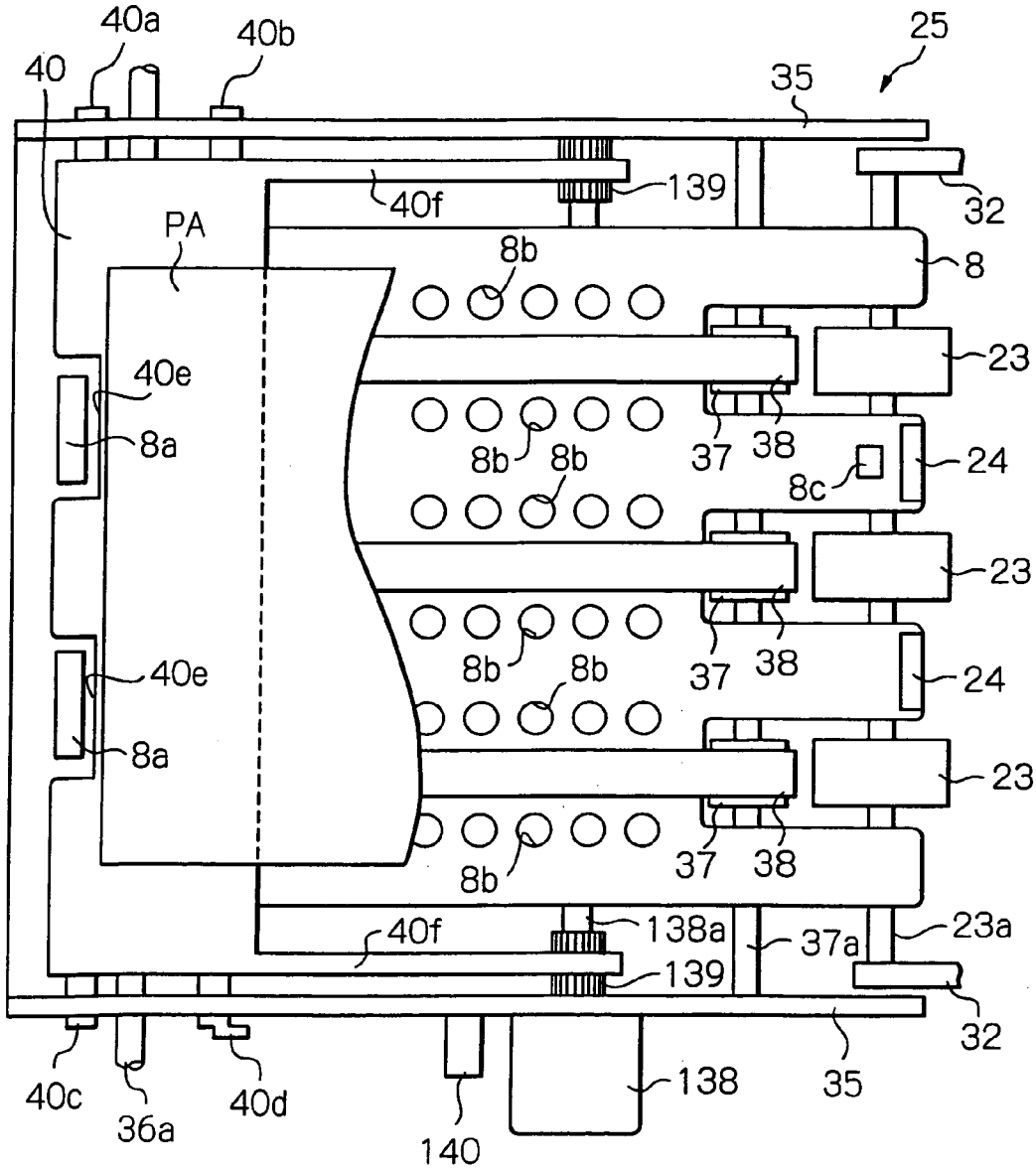
FIG. 3 is a plan view showing a general construction of a main portion of the refeeding means.

The suction fan 39 is mounted on the bottom of the main body 35 while the auxiliary tray 8 is mounted on the top of the main body 35. The auxiliary tray 8 is constructed such that a part of the circumference of each of the rollers 36 and 37 face the sheet conveyance surface, and as shown in FIG. 3, a plurality of openings 8*b* are formed on both sides of each endless belt 38 on the sheet conveyance surface. Two end fences 8*a* are formed integrally with the auxiliary tray 8 in the downstream end portion thereof in the sheet conveyance direction, for receiving an end of the front-side-printed sheet PA which is fed from the printing section 2.

Arranged in the upstream end portion of the auxiliary tray 8 in the sheet conveyance direction is the refeed positioning member 24 for temporarily stopping at a fixed position the other end of the front-side-printed sheet PA that is to be refed to the printing section 2 by the refeed conveying member 25. In this embodiment, two refeed positioning members 24 are provided, each of which are integrally attached to the auxiliary tray 8. Further, the auxiliary tray 8 is provided with a sensor 8*c* that detects the approach of the other end of the front-side-printed sheet PA toward the refeed positioning members 24. The sensor 8*c* outputs a signal to control means 129 described later upon detecting the other end of the front-side-printed sheet PA.

A not-shown hole is provided in the lower surface of the main body 35 to which the suction fan 39 is attached. With this arrangement, as the suction fan 39 operates, a negative pressure is generated in the interior of the main body 35 that serves as a housing, causing the front-side-printed sheet PA to be sucked onto the upper surface of each of the moving endless belt 38. The sucking force of the fan 39 and the frictional resistance of the endless belt 38 are set such that when the other end of the front-side-printed sheet PA abuts against the refeed positioning member 24, slip occurs between the front-side-printed sheet PA and each endless belt 38.

The above-mentioned auxiliary tray 8, refeed guide means 22, refeed registration roller 23, refeed positioning member 24, and refeed conveying member 25 together constitute the refeeding means 9. Further, the refeeding means 9 includes a sheet receiving plate 40 as shown in FIG. 1, FIG. 2, and FIG. 3. Hereinbelow, the sheet receiving plate 40 is described.

As shown in FIG. 3, the sheet receiving plate 40 having a C-shaped cross section includes protrusions 40*a*, 40*b*, 40*c*, and 40*d* in its both side portions. Each of the protrusions 40*a*, 40*b*, 40*c*, and 40*d* is fitted in each of elongate holes (not shown) formed in both side plates of the main body 35. Further, formed in one end portion of the sheet receiving plate 40 are notches 40*e* in each of which each end fence 8*a* can be fitted, and formed on both side portions of the sheet receiving plate 40 are rack portions 40*f* extending to the other end side of the sheet receiving plate 40. The sheet receiving plate 40 is arranged at a position upwardly spaced from each endless belt 38. The distance between the lower surface of the sheet receiving plate 40 and each endless belt 38 is set to a predetermined value such that the front-side-printed sheet PA can be smoothly conveyed on each endless belt 38.

Mounted outside one of the side plates of the main body 35 is a stepping motor 138 having two pinions 139 on its output shaft 138. The forward end of the output shaft 138*a* is rotatably supported to the other side plate of the main body 35, with each pinion 139 being arranged at a position near the either side plate of the main body 35 and where it is in mesh with each rack portion 40*f*.

Arranged near the stepping motor 138 is a home position sensor 140 for detecting the home position of the sheet receiving plate 40. The home position sensor 140 is arranged at a position where it can detect the projection portion of the protrusion 40*d*, and a signal from the home position sensor 140 is output to control means 129 described later.

Figure 4:
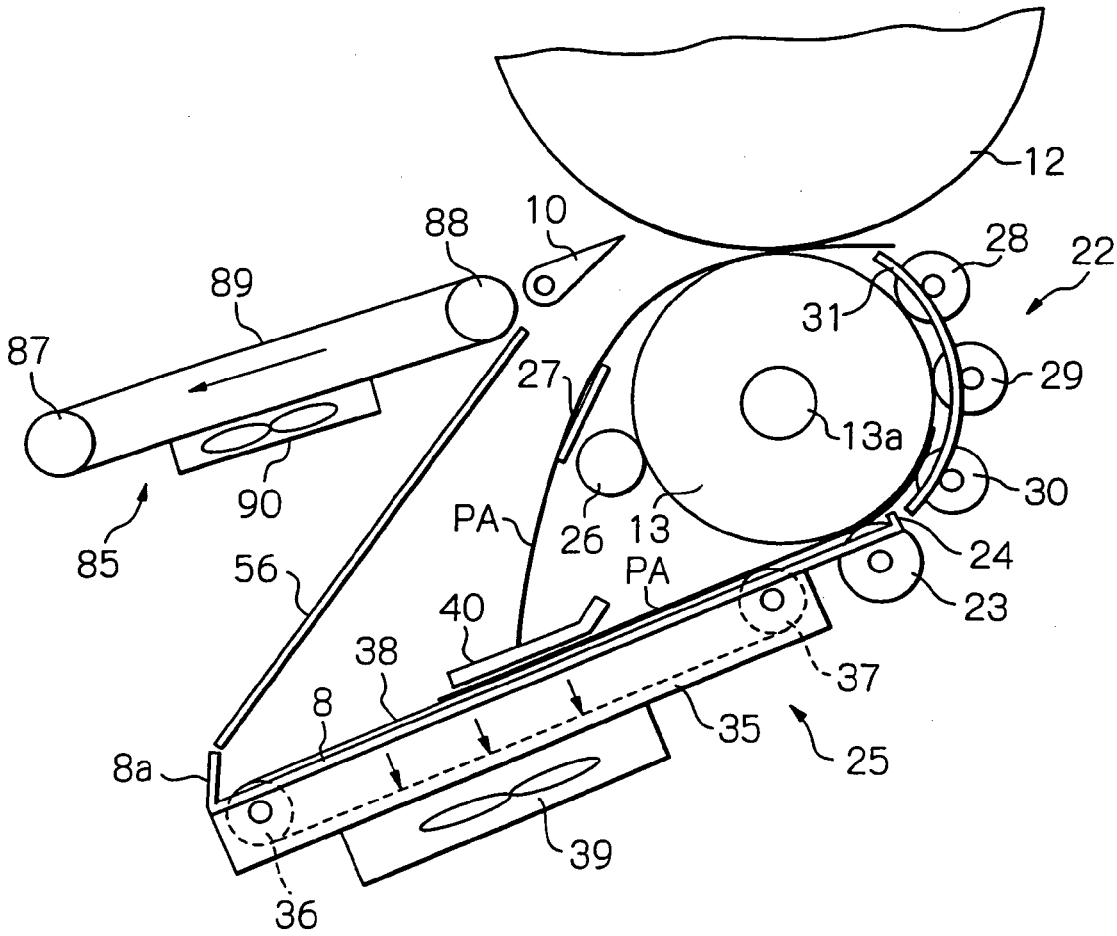
FIG. 4 shows behaviors of a sheet receiving plate held in a first position, which is used in the duplex printer, and of a front-side-printed sheet.
Figure 5:
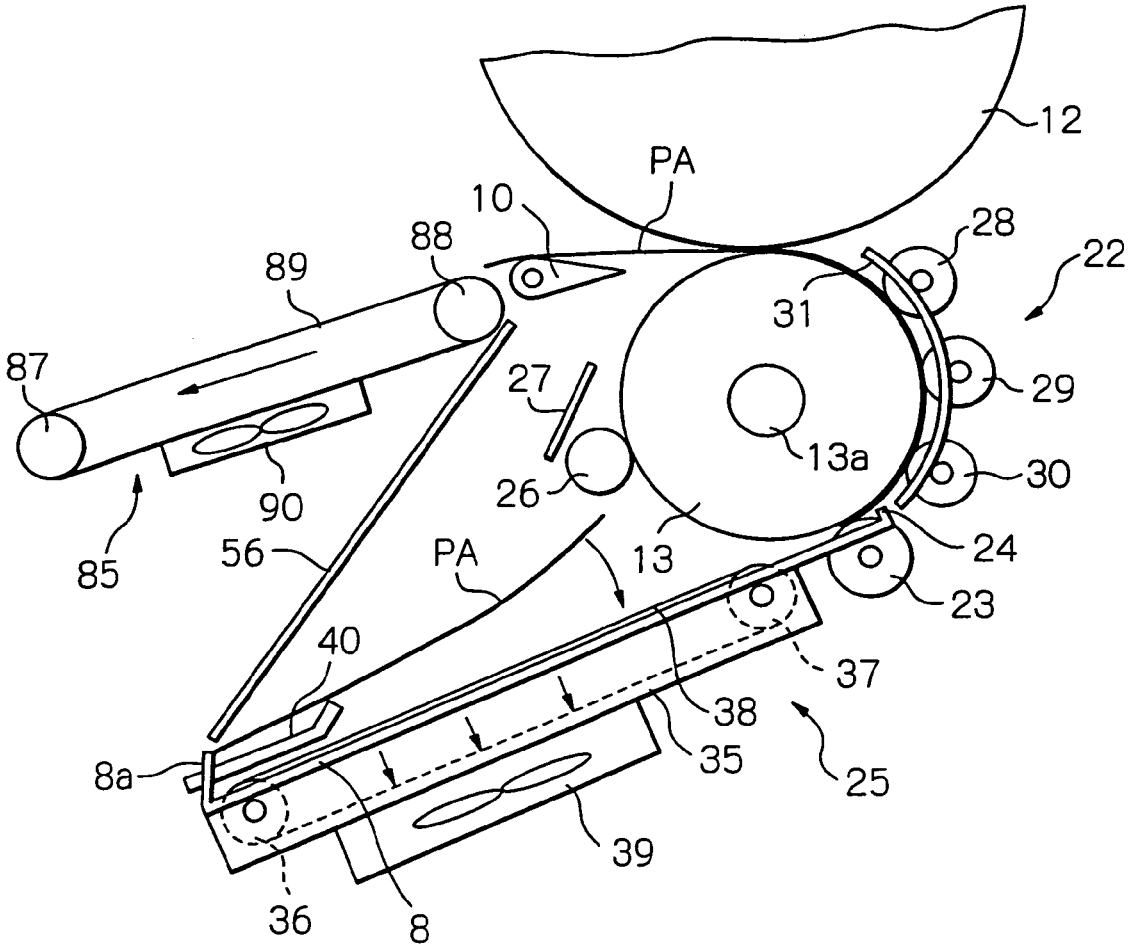
FIG. 5 shows behaviors of the sheet receiving plate held in a second position, which is used in the duplex printer, and of the front-side-printed sheet.

The sheet receiving plate 40, constructed as described above, is caused to reciprocate due to the stepping motor 138 so as to selectively assume a first position that is a home position shown in FIG. 4, in which the sheet receiving plate 40 most approaches the press roller 13 to receive one end of the front-side-printed sheet PA conveyed from the printing section 2, and a second position shown in FIG. 5, in which the sheet receiving plate 40 is most spaced apart from the press roller 13 and the other end of the front-side-printed sheet PA stacked on the upper surface of the sheet receiving plate 40 contacts each endless belt 38.

The length of the sheet receiving plate 40 in the sheet conveyance direction is set such that, when the sheet receiving plate 40 is assuming the second position, and the other end of the front-side-printed sheet PA on the sheet receiving plate 40 drops off from the sheet receiving plate 40 onto each endless belt 38 and the front-side-printed sheet PA is conveyed by the refeed conveying member 25 so that its other end abuts against the refeed positioning member 24, one end of the front-side-printed sheet PA drops off from the sheet receiving plate 40 that is assuming the second position.

The cleaning roller 26 is positioned in the vicinity of the press roller 13 above the refeed conveying member 25 in order to clean the surface of the press roller 13. The cleaning roller 26 has substantially the same width as the press roller 13 and includes a core 26*a*. At least the surface of the cleaning roller 26 is formed of Japanese pager, sponge or similar highly water-absorptive material. The core 26*a* is received in slots formed in the arms 20, so that the cleaning roller 26 is freely rotatable. Biasing means (not shown) are positioned in the slots of the arms 20 and constantly bias the cleaning roller 26 toward the press roller 13, thereby pressing the cleaning roller 26 against the press roller 13 with predetermined pressure. Cleaning roller drive means (not shown) is mounted on one of the arms 20 for causing the cleaning roller 26 to rotate in the same direction as the press roller 13, but at a peripheral speed about one-tenth of the peripheral speed of the press roller 13, when the press roller 13 is rotated.

The guide plate 27 is positioned above and at the left-hand side of the cleaning roller 26. The guide plate 27, affixed to the arms 20 at its opposite ends, guides the front-side-printed sheet PA sent from the printing section 2 such that the sheet PA moves toward the auxiliary tray 8 without contacting the cleaning roller 26. The guide plate 27 adjoins the press roller 13 and cleaning roller 26.

A rotatable cam follower 41 is mounted on the other end of each arm 20 remote from the press roller 13. A print pressure spring 42 is anchored at one end to the printer main body 11 and at the other end to each arm 20 in the vicinity of the cam follower 41. Such print pressure springs 41 constantly bias the arms 20 clockwise, as viewed in FIG. 2, about the shaft 21.

Figure 6:
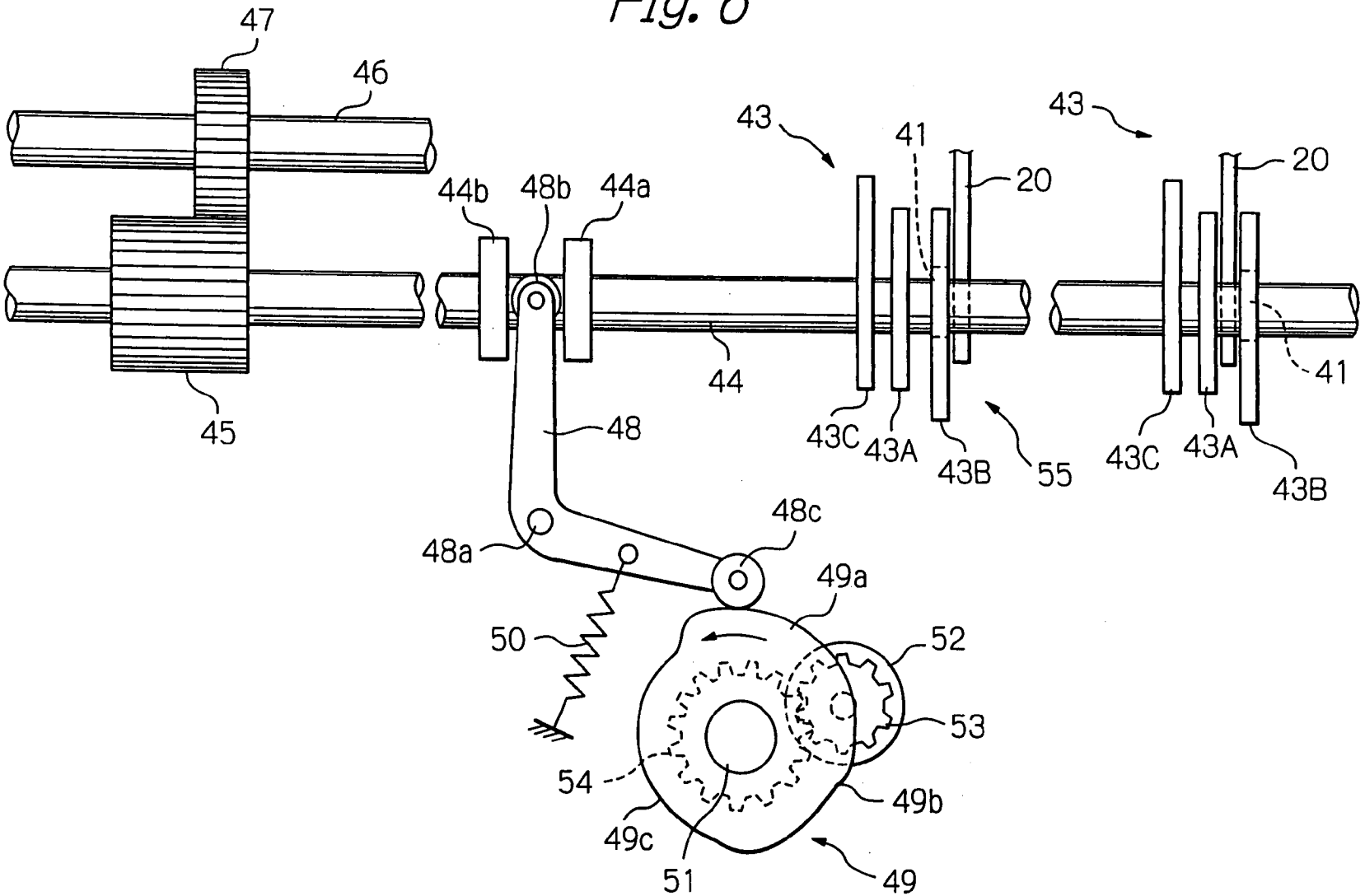
FIG. 6 is a side view showing a general construction of a press roller moving mechanism used in the duplex printer.

A multiple-step cam 43 is positioned at the left-hand side of each cam follower 41 and has three cam plates 43A, 43B, and 43C, which is journalled to the printer main body 11 and freely movable in the direction perpendicular to the sheet surface of FIG. 2. The cam plates 43A through 43C are positioned in this order from the front to the rear and spaced from each other by a predetermined distance. The cam plates 43A through 43C each have a disk-like base portion coaxial with the cam shaft 44 and a projection; the projections of the cam plates 43A and 43C are identical in amount with each other. As shown in FIG. 6, a drive gear 45 is mounted on the cam shaft 44 while a transmission gear 47 is mounted on a shaft 46 journalled to the printer main body 11. The drum drive means 121 causes the cam 43 to rotate clockwise, as viewed in FIG. 2, via the gear 47.

Figure 7:
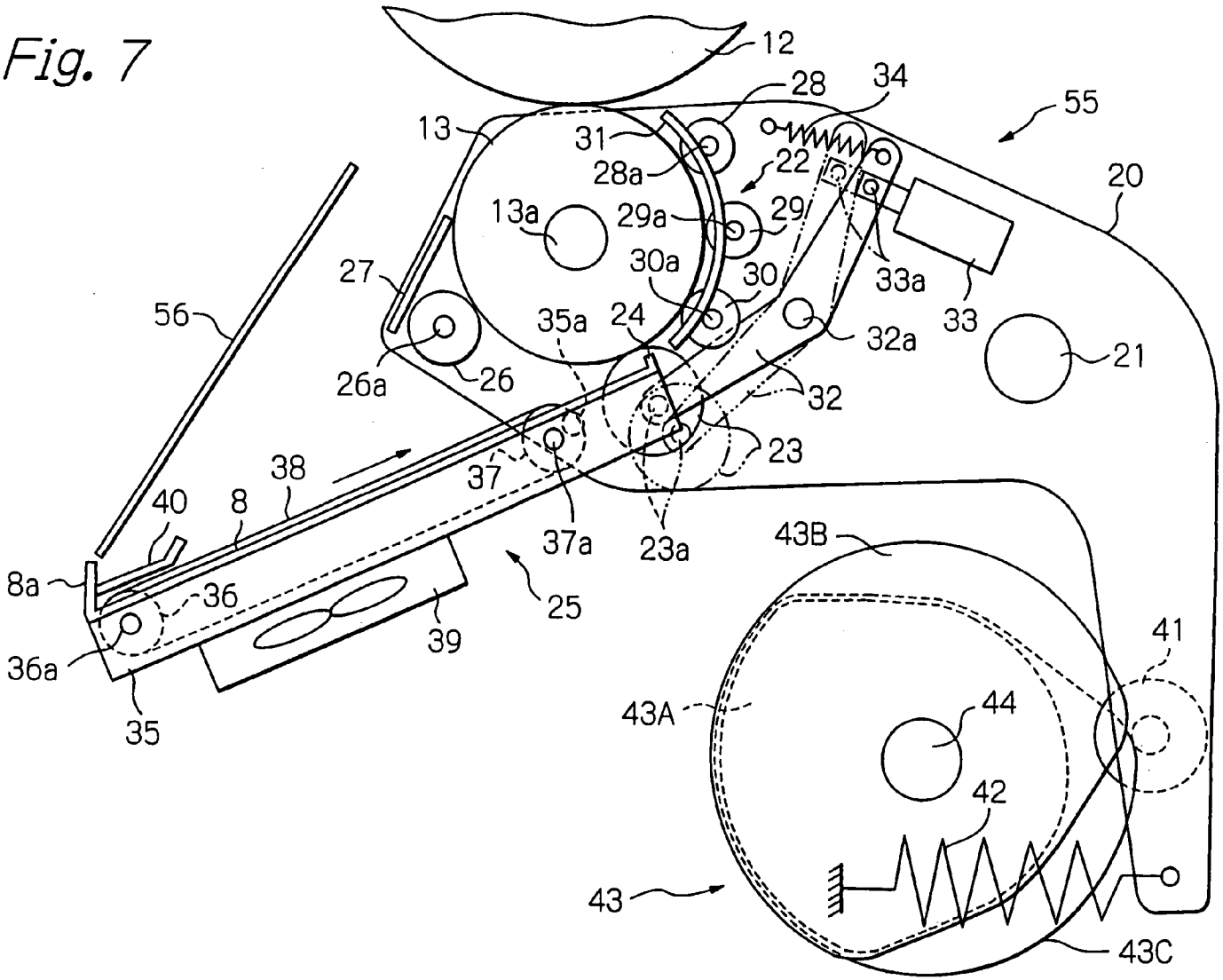
FIG. 7 is a front view showing the press roller that is in contact with the outer peripheral surface of the print drum, and the construction of the main portion of the refeeding means, which are used in the duplex printer.

When the projection of any one of the cam plates 43A through 43C is brought into contact with the cam follower 41, the press roller 13 is released from the print drum 12, as shown in FIG. 2. When the projection is released from the cam follower 41, the press roller 13 is pressed against the print drum 12 due to the biasing force of the print pressure spring 42, as shown in FIG. 7. The cam plates 43A through 43C each are configured such that its base portion does not contact the cam follower 41 when the press roller 13 is pressed against the print drum 12.

The projection of the cam plate 43A is configured to cause the press roller 13 to contact the print drum 12 over a range including a front zone, an intermediate zone and a reverse zone shown in FIG. 1. The projection of the cam plate 43B is configured to cause the press roller 13 to contact the print drum 12 over the front zone. Further, the projection of the cam plate 43C is configured to cause the press roller 13 to contact the print drum 12 over the downstream portion of the cam plate 43C, intermediate zone, and reverse zone. The cam plates 43A through 43C are spaced from each other by a distance sufficiently greater than the thickness of each arm 20.

In FIG. 2, press roller locking means (not shown) is positioned at the right-hand side of the arms 20 for preventing the arms 20 from angularly moving when the press roller 13 is spaced from the print drum 12. More specifically, the press roller locking means includes a solenoid (not shown) for selectively locking or unlocking the arms 20 when energized or deenergized, respectively. The solenoid is operated in the condition in which the cam follower 41 is held in contact with the projection of any one of the cam plates 43A through 43C.

As shown in FIG. 6, a generally L-shaped movable arm 48 and a stepped cam 49 are positioned below the cam shaft 44. The arm 48 is mounted on a shaft 48*a*, which is journalled to the printer main body 11, at its bent portion. A roller 48*b* and a cam follower 48*c* are rotatably mounted on one end and the other end of the arm 48, respectively. A tension spring 50 is anchored at one end to the printer main body 11 and at the other end to part of the arm 48 intervening between the bent portion and the cam follower 48*c*, constantly biasing the arm 48 clockwise, as viewed in FIG. 6, about the shaft 48*a*.

The roller 48*b* is positioned between disks 44*a* and 44*b* mounted on the intermediate portion of the cam shaft 44 and spaced from each other. The cam follower 48*c* is pressed against the stepped cam 49 by the bias of the tension spring 50. The distance between the disks 44*a* and 44*b* is selected to be slightly greater than the diameter of the roller 48*b*.

The stepped cam 49 has three cam portions 49*a*, 49*b* and 49*c* on its circumference and is mounted on a shaft 51 journalled to the printer main body 11. A gear 54 is mounted on the shaft 51 and held in mesh with a gear 53 mounted on the output shaft of a stepping motor 52. The stepping motor 52 causes the stepped cam 49 to rotate in a direction indicated by an arrow in FIG. 6. In this configuration, when the stepping motor 52 rotates the stepped cam 49, the arm 48 angularly moves about the shaft 48*a* and causes the roller 48*b* to push the disk 44*a* or 44*b*, thereby causing the cam shaft 44 to move in the right-and-left direction in FIG. 6.

The cam portions 49*a* through 49*c* of the stepped cam 49 are so configured as to move the cam shaft 44 in the following manner. When the cam portion 49*a* of the stepped cam 49 contacts the cam follower 48*c*, the cam plate 43B is moved to a position where it can contact the cam follower 41. When the cam portion 49*b* contacts the cam follower 48*c*, the cam plate 43A is moved to the position where it can contact the cam follower 41. Further, when the cam portion 49*c* contacts the cam follower 48*c*, the cam plate 43C is moved to the position where it can contact the cam follower 41.

The cam follower 41, print pressure spring 42, multiple-step cam 43, press roller locking means, arm 48 and stepped cam 49 constitute the press roller moving mechanism 55. The press roller moving mechanism 55 selectively moves the press roller 13 to the spaced position of FIG. 2 or the contact position of FIG. 7.

The path selector 10 is positioned on the sheet conveyance path for the sheet P at the left-hand side of the position where the print drum 12 and press roller 13 contact. The path selector 10 is implemented as a plate and is mounted on a shaft at its downstream end. This shaft is journalled to the printer main body 11. A solenoid 123 (see FIG. 11) selectively locates the upstream end of the path selector 10 at a first position indicated by a solid line in FIG. 1 or a second position indicated by a two-dot chain line in FIG. 1.

At the first position, the upstream end of the path selector 10 adjoins the press roller 13 and does not interfere with the clamper 19*b* mounted on the print drum 12. At the second position, the upstream end of the path selector 10 adjoins the print drum 12. The path selector 10, when held in the first position, steers the front-side-printed sheet PA coming out of the nip between the print drum 12 and the press roller 13 toward the sheet discharging section 6. The path selector 10, when held in the second position, steers the sheet PA toward the auxiliary tray 8 via the path between the guide plate 27 and a guide plate 56 mounted on the printer main body 11.

Figure 8:
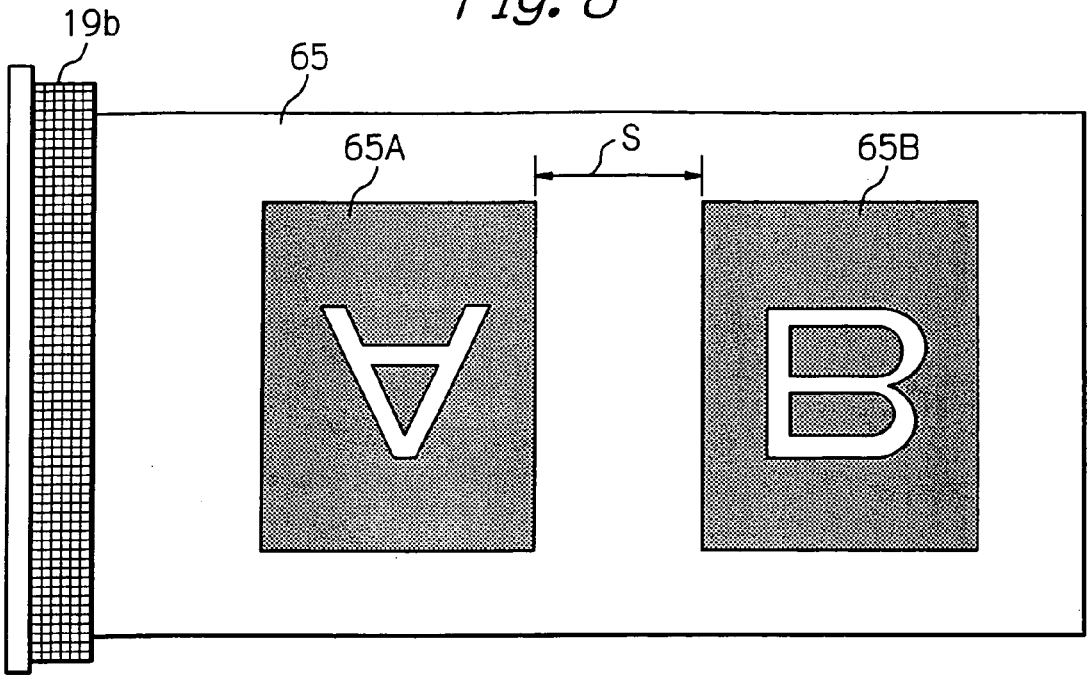
FIG. 8 shows a master formed with two perforated images which is used in the duplex printer.
Figure 9:
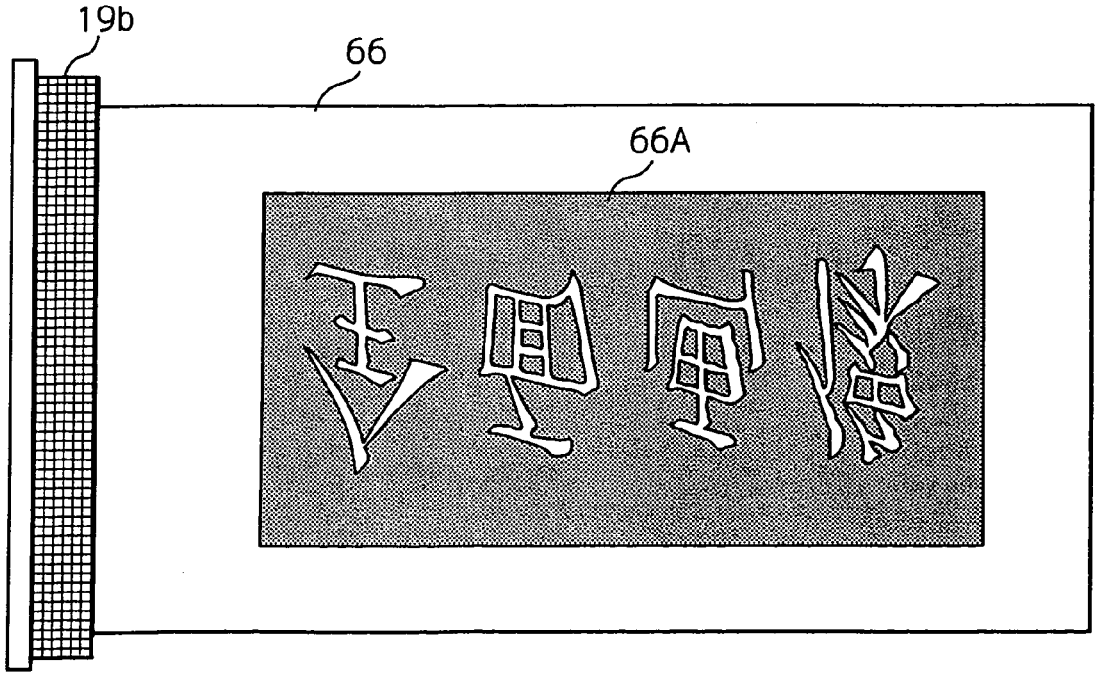
FIG. 9 shows a perforated master used in the duplex printer.

The master making section 3 is arranged in the upper right portion of the printer main body 11 and includes a master support member 57, a platen roller 58, a thermal head 59, cutting means 60, a master stocking portion 61, a tension roller pair 62, and a turn roller pair 63. The master making section 3 perforates a master 64, which will be described later, to thereby produce a master 65 which is shown in FIG. 8 or a master 66 shown in FIG. 9. The master 65 has first and second perforated image 65A and 65B while the master 66 has a third perforated image 66A having an area that is the sum of the areas of the first and second perforated images 65A and 65B. The first perforated image 65A is formed such that it corresponds to the front zone of the print drum 12, as shown in FIG. 1, when the master 65 is wrapped around the print drum 12. Also, the second image 65B is formed such that it corresponds to the reverse zone of the print drum 12 when the master 65 is wrapped around the print drum 12.

The master support member 57 is mounted on each of opposite side plates of the master making section 3. The master 64 is made up of a thermoplastic resin film and a porous support adhered to each other and implemented as a roll 64*a* rolled on a core 64*b*. The core 64*b* is rotatably, removably supported by the master support members 57 at its opposite ends.

The platen roller 58, positioned at the left-hand side of the master support members 57, is journalled to the side plates of the master making section 3 and caused to rotate by master-making drive means 124 (see FIG. 11) including a stepping motor. The thermal head 59, positioned beneath the platen roller 58, has a number of heat-generating elements and is supported by the side plates of the master making section 3. Biasing means (not shown) constantly presses the heating surface of the thermal head 59 against the platen roller 58. The thermal head 59 causes its heat-generating elements to selectively generate heat in contact with the thermoplastic resin film of the master 64, thereby perforating or cutting the master 64.

The cutting means 60, positioned at the left-hand side of the platen roller 58 and thermal head 59, is made up of a stationary edge 60*a* affixed to the side plates (not shown) of the master making section 3 and a movable edge 60*b* movably supported by the stationary edge 60*a*. The movable edge 60*b* rotates relative to the stationary edge 60*a* to thereby cut the master 64 at a predetermined length.

The master stocking section 61, positioned downstream of the cutting means 60 in the direction of master feed, forms a space for temporarily accommodating the master 65 or 66. The master stocking portion 61 is divided into a plurality of chambers by plates. A suction fan is disposed in one of the chambers located at the deepest position. The suction fan generates negative pressure in the master stocking portion 61, which is a closed space, so that the master 65 or 66 is introduced into the master stocking portion 61 toward the deepest chamber.

The tension roller pair 62, positioned between the cutting means 60 and the master stocking portion 61, is made up of a drive roller 62*a* and a driven roller 62*b* journalled to the side plates of the master making section 3. Biasing means (not shown) presses the driven roller 62*b* against the drive roller 62*a*. The master-making drive means 124 rotates the drive roller 62*a* and thereby causes the drive roller 62*a* and driven roller 62*b* to convey the master 64 while nipping it therebetween. The drive roller 62*a* is rotated at a slightly higher peripheral speed than the platen roller 58 and has a torque limiter in the interior thereof, applying predetermined tension to the master 64 between the platen roller 58 and the tension roller pair 62.

The turn roller pair 63, positioned downstream of the master stocking portion 61 in the direction of master feed, is made up of a drive roller 63*a* and a driven roller 63*b* journalled to the side plates of the master making section 3. The master-making drive means 124 rotates the drive roller 63*a* and thereby causes the drive roller 63*a* and driven roller 63*b* to convey the master 64 while nipping it therebetween. A one-way clutch (not shown) is included in the drive roller 63*a*.

A movable master guide plate (not shown) is positioned between the tension roller pair 62 and the turn roller pair 63 and angularly movably supported by a support member (not shown). A solenoid (not shown) selectively moves the movable master guide plate to an operative position where the upper surface of the plate forms a conveyance path or an inoperative position where the plate does not obstruct the entry of the master 64 in the master stocking portion 61.

The sheet feeding section 4, positioned below the master making section 3, includes a feed tray 67, a pickup roller 68, a separator roller 69, a separator pad 70, and a registration roller pair 71.

The tray 67 is loaded with a stack of sheets P and supported by the printer main body 11 in such a manner as to be movable up and down. Sheet feed drive means 125 provided with an elevating means (see FIG. 11) causes the tray 67 to move up and down. The tray 67 is sized to allow sheets P of size A3 to be stacked thereon in a profile position. A pair of side fences 72 (only one is visible) are mounted on the upper surface of the tray 67 and movable along rails in the widthwise direction of the sheets P perpendicular to the direction of sheet feed. A plurality of sheet size sensors 73 are positioned on the free-end side of the tray 67 for sensing the size of the sheets P stacked on the tray 67.

The pickup roller 68, positioned above the tray 67, has its surface implemented by a member having high frictional resistance. The pickup roller 68 is journalled to a bracket (not shown) angularly movably supported by the printer main body 11. When elevating means (not shown) raises the tray 67, the top sheet P on the tray 67 is brought into contact with the pickup roller 68. The pickup roller 68 is driven by the sheet feed drive means 125.

The separator roller 69 and separator pad 70, located at the left-hand side of the pickup roller 68, each have its surface implemented by a member having high frictional resistance. The separator roller 69 is operatively connected to the pickup roller 68 by a timing belt 69*a* and rotated in synchronism with and in the same direction as the pickup roller 68. Biasing means (not shown) presses the separator pad 70 against the separator roller 69.

The registration roller pair 71, positioned at the left-hand side of the separator roller 69 and separator pad 70, is made up of a drive roller 71*a* and a driven roller 71*b*. Due to a stepping motor 142 provided to the printer main body 11, the drive roller 71*a* is caused to be rotationally driven at a predetermined timing in accordance with the rotation of the print drum 12 and cooperates with the driven roller 71*b* to convey the sheet P toward the printing section 2.

Positioned on the upstream and downstream sides of the registration roller pair 71 in the sheet conveyance direction are sheet guide plates 136 and 137, respectively, for guiding the conveyance of the sheet P that is to be fed from the sheet feeding section 4 to the printing section 2. The sheet guide plates 136 and 137 are fixedly held between the side plates (not shown) of the printer main body 11.

The master discharging section 5, positioned above and at the left-hand side of the printing section 2, includes upper and lower discharging members 74 and 75, a waste master box 76, and a compressor plate 77.

The upper discharging member 74 includes a drive roller 78, a driven roller 79, and an endless belt 80. Master discharge drive means 126 (see FIG. 11) rotates the drive roller 78 clockwise, as viewed in FIG. 1, for thereby moving the belt 80 in a clockwise direction as viewed in FIG. 1. Likewise, the lower discharging member 75 includes a drive roller 81, a driven roller 82, and an endless belt 83. The drive of the master discharge drive means 126 for rotationally driving the drive roller 78 is transferred to the drive roller 81 via drive transmitting means (not shown) including gears and a cam, so that the drive roller 81 rotates counterclockwise, as viewed in FIG. 1, and causes the belt 83 to move in a direction indicated by an arrow in FIG. 1. Moving means (not shown) is included in the master discharge drive means 126 and selectively moves the lower discharging member 75 to a position shown in FIG. 1 or a position where part of the belt 83 passed over the driven roller 82 contacts the print drum 12.

The waste master box 76 for storing a waste or used master 64*c* is removably mounted to the printer main body 11. The compressor plate 77 is supported by the printer main body 11 in such a manner as to be movable up and down and driven by elevating means (not shown) included in the master discharge drive means 126. The compressor plate 77 compresses the waste or used master 64*c* conveyed by the upper and lower discharging members 74 and 75 into the waste master box 76.

The sheet discharging section 6, located below the master discharging section 5, includes a plurality of peelers 84, a conveying member 85, and a print tray 86.

The peelers 84 are mounted on a common shaft angularly movably supported by the printer main body 11 and are spaced from each other in the widthwise direction of the print drum 12. Peeler moving means (not shown) integrally moves the peelers 84 selectively to a position shown in FIG. 1 where the tips of the peelers 84 adjoin the print drum 12 or a position where they are retracted from the print drum 12 for avoiding the clamper 19*b*. The drive of the drum drive means 121 is transferred to the peeler moving means via drive transmitting means (not shown) so that the peelers 84 angularly move in synchronism with the print drum 12.

The conveying member 85 is positioned below the peelers 84 at the left-hand side of the path selector 10 and includes a drive roller 87, a driven roller 88, a belt 89, and a suction fan 90. The drive roller 87 is implemented as segment rollers mounted on a shaft journalled to the side plates of the conveying member (not shown) and spaced from each other by a predetermined distance. Sheet discharge drive means 127 (see FIG. 11) causes the segment rollers to rotate integrally with each other. The driven roller 88 is also implemented as segment rollers mounted on a shaft (not shown) journalled to the unit side walls and spaced from each other by the same distance as the segments of the drive roller 87. The belt 89 is passed over one of the segment drive rollers 87 and corresponding one of the segment driven rollers 88. The suction fan 90 is positioned below the drive roller 87, driven roller 88 and belt 89. The printed sheet PB is conveyed in a direction indicated by an arrow in FIG. 1 in accordance with the rotation of the drive roller 87 while being retained on the belt 89 by the suction fan 90.

The conveying member 85 drives the printed sheet PB out of the printer main body 11 onto the print tray 86. The print tray 86 includes an end fence 91 movable in the direction of sheet conveyance and a pair of side fences 92 movable toward or away from each other in the widthwise direction of the printed sheet PB.

The image scanning section 7 is positioned on the top of the printer main body 11 and includes a glass platen 93 on which a document is to be laid. A cover plate 94 is openable away from the glass platen 93. Mirrors 95, 96, 97, and 98 and a lamp 99 read an image by illuminating the document. Imagewise reflection from the document is focused by a lens 100 on a CCD (Charge Coupled Device) or similar image sensor 101. A plurality of document size sensors 102 sense the size of the document. Image data representative of the document image is written to an image memory 135. Scanning drive means 128 (see FIG. 11) effects such scanning operation.

As shown in FIG. 1, a dog 133 is mounted on the circumference of the end plates (not shown) constituting the print drum 12. A home position sensor 134 is mounted on the printer main body 11 in the vicinity of the print drum 12. When the print drum 12 is rotated to a position where the damper 19*b* faces the press roller 13, the home position sensor 134 senses the dog 133 and feeds its output to control means 129, which will be described later.

Figure 10:
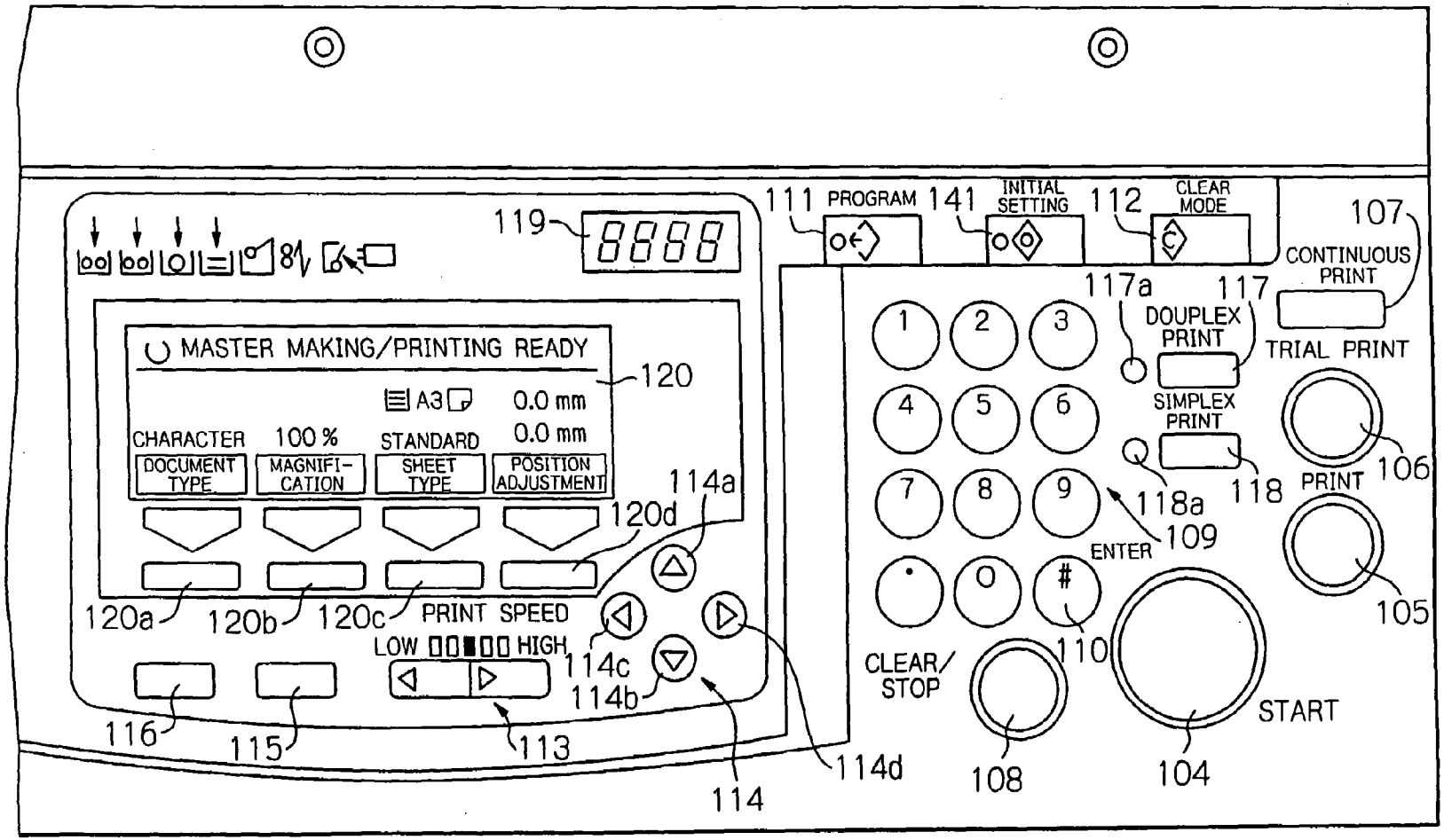
FIG. 10 shows an operation panel used in the duplex printer.

FIG. 10 shows a specific configuration of an operation panel 103 mounted on the top front part of the printer main body 11. As shown, the operation panel 103 includes a master-making start key 104, a print start key 105, a trial print key 106, a continuous print key 107, a clear/stop key 108, numeral keys 109, an enter key 110, a program key 111, a mode clear key 112, print speed keys 113, 4-direction keys 114, sheet size key 115, a sheet thickness key 116, a duplex print key 117, a simplex print key 118, an indicator 119 implemented by segment LEDs (Light Emitting Diodes), a display device or LCD (Liquid Crystal Display) 120, an initial setting key 141, and the like.

When the operator presses the master-making start key 104, the printer 1 performs a master discharging operation and an image scanning operation and then performs a master wrapping operation. In this condition, the operator inputs various printing conditions and then presses the print start key 105. In response, the printer 1 performs a printing operation. When the operator, after input of the various printing conditions, presses the trial print key 106, the printer 1 produces a single trial print. When the operator presses the continuous print key 107 before the master-making start key 104, the printer 1 continuously performs the master discharging operation, image scanning operation, master making operation and printing operation in this order.

The clear/stop key 108 may be pressed to interrupt the operation of the printer 1 under way or to clear a numerical value input. The numeral keys 109 are used to input numerical values. The enter key 110 is used to set, e.g., numerical values at the time of setting while the program key 111 is used to register or call operations of frequent use. The mode clear key 112 may be pressed to clear various modes input. The print speed keys 113 are used to lower the print speed for increasing image density when ambient temperature is low or to raise the print speed for reducing image density when ambient temperature is high. The 4-direction keys 114 are an up key 114*a*, a down key 114*b*, a left key 114*c*, and a right key 114*d*, which are pressed for adjusting the image position during image editing, selecting numerical values and other such items during various settings, and the like.

The sheet size key 115 may be pressed to input a desired sheet size. A sheet size selected on the sheet size key 115 has priority over a sheet size sensed by the sheet size sensors 73. The sheet thickness key 116 is used to input the thickness of the sheets P to be used in a duplex copy mode; in the illustrative embodiment, any one of a plain sheet, a thin sheet and a thick sheet may be selected.

When the operator, intending to obtain a duplex print, presses the duplex print key 117 before the master-making start key 104, an LED 117*a* adjacent to the key 117 turns on to show the operator that the duplex print mode has been set. In the duplex print mode, the printer 1 invalidates the operation of the master-making start key 104 until the operator inputs the thickness of the sheets P to use with the sheet thickness key 116. When the operator, intending to obtain a simplex print, presses the simplex print key 118 before the master-making start key 104, an LED 118*a* adjacent the key 118 turns on to show the operator that the simplex print mode has been set. The printer 1 initially sets the simplex print mode while turning on the LED 118*a*.

The indicator 119 composed of 7 segment LEDs mainly displays the number of prints produced and other numerical values. The display device or LCD 120 has a hierarchical display structure. By pressing any one of setting keys 120*a* through 120*d* positioned below the LCD 120, the operator is capable of selecting various modes including a magnification mode and a position adjustment mode. Further, the LED 120 displays the status of the printer 1, e.g., a message "Ready to print." shown in FIG. 10 as well as other messages indicative of a master jam, a sheet jam, and a master, ink or similar supply command.

The initial setting key 141 is pressed when changing an initial setting value of the duplex printer 1. When the initial setting key 141 is pressed, various setting values are displayed on the LCD 120. Those setting values are selected and set by pressing the ten key 109, the selection setting keys 120*a*, 120*b*, 120*c*, and 120*d*, and the 4-direction keys 114.

Figure 11:
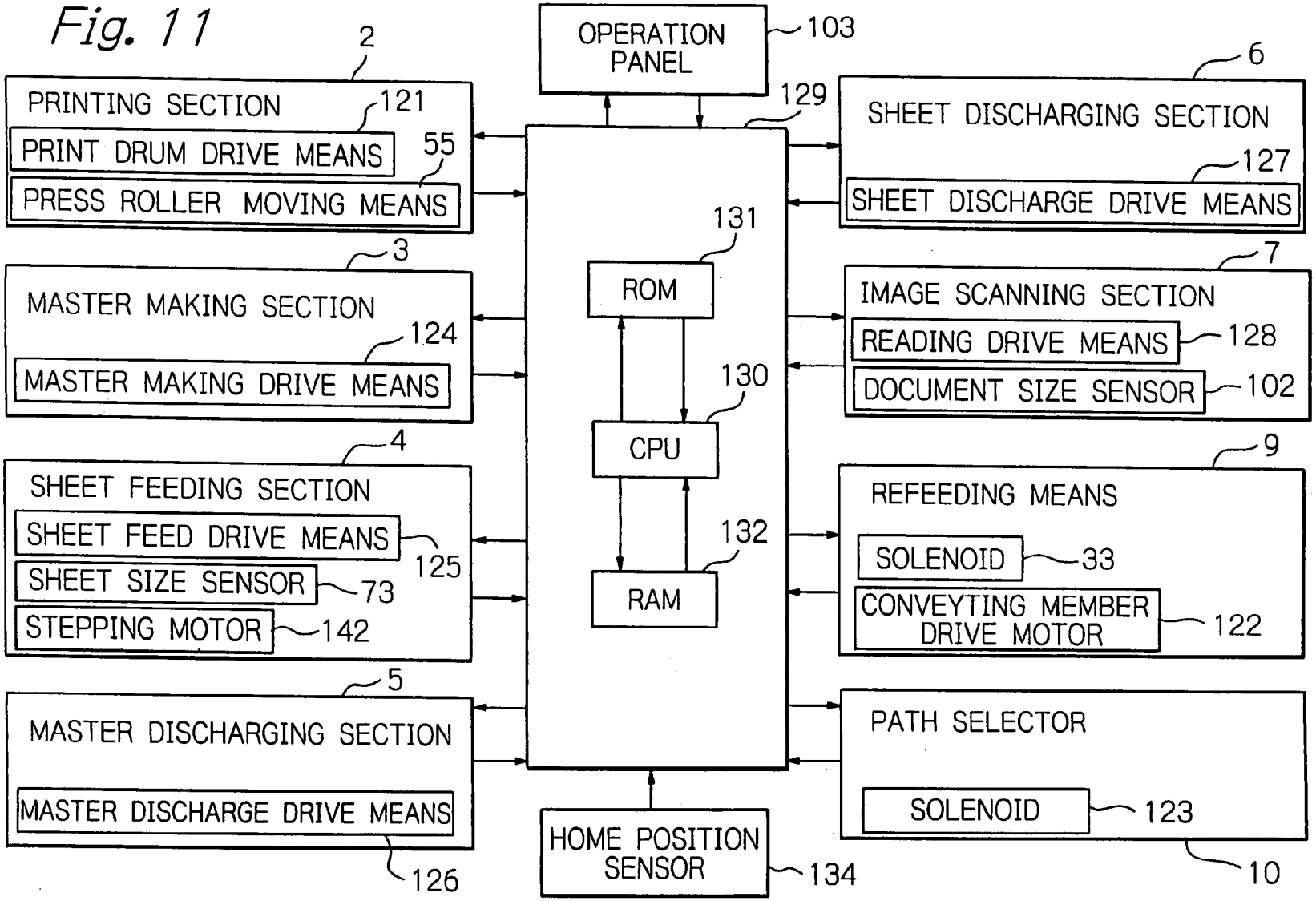
FIG. 11 is a black diagram showing a configuration of a control device used in the duplex printer.

FIG. 11 shows a control system for the printer 1. As shown, the control system includes control means 129 implemented as a conventional microcomputer including a CPU (Central Processing Unit) 130, a ROM (Read Only Memory) 131 and a RAM (Random Access Memory) 132 and disposed in the printer main body 11.

The CPU 130 controls the operation of the entire printer 1. More specifically, the CPU 130 controls the drive means included in the printing section 2, master making section 3, sheet feeding section 4, master discharging section 5, sheet discharging section 6 and image scanning section 7, the solenoids 33 and 123, the conveyor drive motor 122, the stepping motor 142, and the like in accordance with signals fed from the operation panel 103, outputs of various sensors mounted on the printer main body 11, and a program read out of the ROM 131. The operation program for the entire printer 1, which is stored in the ROM 131, is read out by the CPU 130, as needed. The RAM 132 has functions of temporarily storing the computation results from the CPU 130, storing, as required, data and on/off signals set or input with various keys on the operation panel 103 and from various sensors, and the like. The control means 129 additionally determines the position of the print drum 12 in accordance with a home position signal output from the home position sensor 134 and a signal output from an encoder (not shown) included in the drum drive means 121.

The operation of the printer 1 will be described hereinafter.

The operator of the printer 1 stacks the sheets P on the tray 67, opens the cover plate 94 to lay a desired document on the glass platen 93, and then closes the cover plate 94. After setting desired print conditions on the operation panel 103, the operator presses either one of the duplex print key 117 and simplex print key 118 and then presses the master-making start key 104. First, assume that the operator selects the simplex print mode with the simplex print key 118.

After seeing the turn-on of the LED 118*a* assigned to the simplex print mode, the operator presses the master-making start key 104. In response, the sheet size sensors 73 and document size sensors 102 send their outputs to the control means 129. The control means 129 compares the outputs of the sensors 73 and those of the sensors 102 to see if the sheet size and document size are identical or not. If the sheet size and document size are identical, then the control means 129 causes the image scanning operation to start immediately. If the two sizes are not identical, then the control means 129 displays a message showing the operator the non-coincidence. When the sheet size and document size are different, the control means 129 may send a command for automatically executing magnification change or image rotation to thereby match the two sizes.

When the operator presses the master-making start key 104, the image scanning section 7 scans the document with the lamp 99, mirrors 95 through 98, lens 100, and image sensor 101. An electric signal output from the image sensor 101 is input to an A/D (Analog-to-Digital) converter (not shown) disposed in the printer main body 11 and then written to the image memory 135 as a image data signal.

In parallel with the image scanning operation by the image scanning section 7, the master discharging section 5 performs the master discharging operation, i.e., removes the used master 64*c* wrapped around the print drum 12. More specifically, on the operation of the master-making start key 104, the print drum 12 starts rotating. When the print drum 12 reaches the home position shown in FIG. 1, the home position sensor 134 senses the dog 133 and sends a home position signal to the control means 129. In response, the control means 129 starts counting encoder pulses. When the control means 129 determines, based on the encoder pulses, that the leading end of the used master 64*c* present on the print drum 12 has reached a predetermined discharge position corresponding to part of the belt 83 passed over the drive roller 82, the control means 129 stops the operation of the drum drive means 121.

When the drum drive means 121 stops operating and stops the print drum 12 at the predetermined master discharge position, the drum drive means 121 and master discharge drive means 126 are operated to rotate the drive rollers 78 and 81 and move the lower discharge member 75 toward the print drum 12. As a result, part of the belt 83 passed over the driven roller 82 is brought into contact with the used master 64*c* present on the print drum 12. The rotation of the print drum 12 and the movement of the belt 83 cooperate to lift the used master 64*c* away from the print drum 12. Subsequently, the lower discharge member 75 cooperates with the upper discharge member 74 to peel off the used master 64*c* from the print drum 12. The used master 64*c* thus removed from the print drum 12 is introduced in the waste master box 76 and then compressed by the compressor plate 77.

Even after the removal of the used master 64*c*, the print drum 12 is continuously rotated until it reaches a predetermined master waiting position where the damper 19*b* is positioned substantially at the right of the print drum 12. When the print drum 12 stops rotating at the master waiting position, the opening/closing means opens the damper 19*b* away from the stage of the print drum 12. In this condition, the printer 1 waits for the feed of a master.

In parallel with the master discharging operation, the master making section 3 performs the master making operation. More specifically, when the operator presses the master-making start key 104, the platen roller 58, tension roller pair 62, and turn roller pair 63 are rotated to pullout the master 64 from the roll 64*a*. At this instant, the movable master guide plate is located at its conveying position. When the image forming area of the master 64 is brought to a position corresponding to the heat-generating elements of the thermal head 59, the image data stored in the image memory 135 and processed are read out and fed to a thermal head driver (not shown). The thermal head driver causes the heat-generating elements of the thermal head 59 to selectively generate heat in accordance with the image data, thereby forming the third perforated image 66A in the thermoplastic resin film of the master 64. As soon as the leading end of the master 64 being so perforated is nipped by the turn roller pair 63, the movable master guide plate is retracted while the turn roller 63 is caused to stop rotating.

The platen roller 58 and tension roller pair 62, continuously rotating even after the stop of rotation of the turn roller pair 63, convey the perforated part of the master 64, i.e., the master 66 into the master stocking portion 61. At the time when the turn roller pair 63 stops rotating, the suction fan of the master stocking portion 61 starts operating to smoothly suck the master 66 into the master stocking section 61.

When the printer 1 reaches the stand-by state after the completion of the master discharging operation while the master making operation is under way, the turn roller pair 63 starts rotating to convey the master 66 toward a position between the stage 19*a* and the damper 19*b* out of the master stocking portion 61. When the leading end of the master 66 reaches a predetermined position, the opening/closing means closes the damper 19*b* and causes the leading end to be retained on the print drum 12 by means of the stage 19*a* and the damper 19*b*.

Subsequently, the print drum 12 is intermittently rotated clockwise, as viewed in FIG. 1, so that the master 66 is wrapped around the print drum 12. At this instant, the turn roller pair 63 is in a halt while the drive roller 63*a* is rotated by the master 66 being pulled out via the one-way clutch thereof. As soon as the image data signal from the image memory 135 ends, the thermal head 59 stops operating, completing the master 66. At this time, when a judgment is made that making and conveying of one master 66 has been completed from the number of steps of the stepping motor (not shown) that causes the platen roller 58 to rotate, the platen roller 58, tension roller pair 62, and turn roller pair 63 are caused to stop rotating while the cutting means 60 is operated to cut off the master 66. The master 66 thus cut off is pulled out of the master making section 3 by the print drum 12 in rotation. The master making and feeding step ends when the print drum 12 reaches its home position.

The master feeding operation is followed by a master sticking operation. More specifically, when the print drum 12 is brought to a stop at the home position, the press roller locking means (not shown) is operated to retain the press roller 13 in the released position. Subsequently, the stepping motor 52 is driven to rotate the stepped cam 49 to a position where the cam portion 49*b* contacts the cam follower 48*c*. As a result, the arm 48 is angularly moved about the shaft 48*a* to move the cam shaft 44 to the position where the cam plate 43A is capable of contacting the cam follower 41. After the cam shaft 44 has been thus moved, the operation of the press roller locking means is stopped, thus canceling the retained state of the press roller 13. At this time, the path selector 10 is held in the first position.

In the above condition, the pickup roller 68, separator roller 69, drive roller 87 and suction fan 90 are driven while the print drum 12 is rotated clockwise, as viewed in FIG. 1, at a low speed. As a result, the top sheet P on the tray 67 is paid out until its leading end abuts against the nip of the registration roller pair 71. At the time when the leading end, in the direction of rotation of the print drum 12, of the master 66 present on the print drum 12 reaches a position where it faces the press roller 13, the stepping motor 142 is operated to drive the drive roller 71*a*, thereby conveying the sheet P toward the position between the print drum 12 and the press roller 13.

In the press roller moving mechanism 55, the cam shaft 44 and multiple-step cam 43 are driven in synchronism with the rotation of the print drum 12, so that the cam plate 43A capable of contacting the cam follower 41 is rotated to move its projection away from the cam follower 41 at the predetermined timing mentioned above. As a result, the press roller 13 is pressed against the print drum 12 due to the biasing force of the print pressure spring 42, pressing the sheet P against the master 66 wrapped around the print drum 12.

Consequently, the ink applied from the ink roller 16 to the inner periphery of the print drum 12 exudes through the opening portions of the print drum 12 and filled into the porous support of the master 66 wrapped around the print drum 12 via the porous support plate (not shown) and the mesh screen (not shown) that constitute the print drum 12, before being transferred to the sheet P through the perforations of the master 66. The above series of operations completes sticking of the master 66 to the print drum 12.

The sheet P to which an image corresponding to the third perforated image 66A is transferred by the above sticking operation is steered by the path selector 10 toward the sheet conveying member 85 as the printed sheet PB while being peeled off from the master 66 on the print drum by the peeler 84 from its leading end side. The printed sheet PB thus peeled off then drops downward to be received by the sheet conveying member 85 and then discharged to the print tray 86 by the belt 89 while being sucked by the suction fan 90. Subsequently, the print drum 12 is again rotated to the home position and stopped there, completing the master sticking operation. In this condition, the printer 1 remains in a stand-by state until the printing operation begins.

Assume that after the printer 1 has reached the stand-by state, the operator inputs desired printing conditions with the print speed key 113 and various keys on the operation panel 103 and then presses the trial print key 106. Then, the print drum 12 is caused to rotate at a peripheral speed corresponding to a desired input printing speed while one sheet P is fed from the sheet feeding section 4. The sheet P is conveyed via the registration roller pair 71 to the position between the print drum 12 and the press roller 13 and then pressed against the master 66 wrapped around the print drum 12 in exactly the same manner as during master sticking operation. The printed sheet PB thus printed with an image is steered to the sheet discharging section 6 by the path selector 10, peeled off from the master on the print drum by the peeler 84, and then discharged to the print tray 86 by the sheet conveying member 85.

After the position, density, and so forth of the image is confirmed by the trial printing, then the operator inputs a desired number of prints on the numeral keys 109 and then presses the print start key 105. In response, the sheets P are continuously fed from the sheet feeding section 4 and processed in the same manner as the trial print. When the desired number of prints are fully output, the print drum 12 is stopped at the home position, and the printer 1 again waits in the stand-by state.

Assume that the operator presses the duplex print key 117 to select the duplex print mode. Then, after seeing the turn-on of the LED 117*a*, the operator presses the sheet thickness key 116 to select the thickness of the sheets P to be used. In the duplex print mode, an input on the master-making start key 104 is invalidated unless the operator presses the sheet thickness key 116. More specifically, if the operator presses the master-making start key 104 without pressing the sheet thickness key 116, then the control means 129 displays a message urging the operator to set desired sheet thickness on the LCD 120.

In the illustrative embodiment, when the operator selects a plain sheet or a thin sheet with the sheet thickness key 116, an input on the master-making start key 104 is accepted. However, when the operator selects a thick sheet, an input on the master-making start key 104 is invalidated in order to obviate a sheet jam while the control means 129 causes a message urging the operator to select correct sheets to appear on the LCD 120.

Assume that the operator sets plain sheets or thin sheets P on the tray 67, selects sheet thickness corresponding to the sheets P on the sheet thickness key 116, and then presses the master-making start key 104. Then, the control means 129 compares the outputs of the sensors 73 and 102 in the same manner as in the simplex print mode.

In the illustrative embodiment, the maximum sheet size applicable to the print drum 12 is A3, so that the maximum sheet size available in the duplex print mode is A4 landscape. If the document size and sheet size are identical, then the control means 129 effects the image scanning operation immediately. However, if the two sizes are not identical, the control means 129 displays a warning message on the LCD 120, as stated earlier. When the sheet size and the document size are different, the control means 129 may also be configured to issue an instruction to automatically change the enlargement or reduction ratio, thereby matching the document size and the image size with each other, or the control means 129 may be configured to aid the operator by causing LCD 120 to display the procedures for effecting size reduction, rotation of the image data, and the like. If the sheet size is larger than size A4 landscape, then the control means 129 may inhibit the duplex print mode and display a message urging the operator to select the simplex print mode on the LCD 120.

When the operator presses the master-making start key 104, the image scanning section 7 scans the first document image as in the simplex print mode. The document image thus scanned is written to the image memory 135 as a first data signal. Subsequently, the control means 129 displays a message urging the operator to replace the first document with the second document on the LCD 120. The operator, seeing the message, opens the cover plate 94, removes the first document from the glass platen 93, lays the second document on the glass platen 93, and then closes the cover plate 94. When a sensor, not shown, detects that the cover plate 94 is closed and when a sensor (not shown) detects the document on the glass platen 93, the image scanning section 7 scans the second document. The scanned document image is written to the image memory 135 as a second data signal.

In the illustrative embodiment, the operator is expected to lay a desired document on the glass platen 93 by opening and closing the cover plate 94 by hand in both of the simplex and duplex print modes, as stated above. Alternatively, an ADF (Automatic Document Feeder) may be used to automatically convey documents to the glass platen 93. Further, image data may be received from a host located outside of the printer 1. In addition, in the duplex print mode, a single document may be reversed and then conveyed so as to produce two pages of image document from the opposite sides of the document.

In parallel with the image scanning operation, the master discharging section 5 discharges a used master as in the simplex print mode. After the used master 64*c* is peeled off from the print drum 12, the print drum 12 is brought to a stop at the master waiting position, and then the opening/closing means opens the damper 19*b*. In parallel with the master discharging operation, the master making section 3 performs the master making operation in the same sequence as in the simplex print mode except that the first and second perforated images 65A and 65B are sequentially perforated in the thermoplastic resin film of the master 64. As shown in FIG. 8, the first and second perforated images 65A and 65B are spaced from each other by a predetermined blank portion S serving as a non-image area. The blank portion S meets the intermediate zone of the print drum 12 shown in FIG. 1, when the master 65 is wrapped around the print drum 12.

The master 65 with the two perforated images 65A and 65B is temporarily stored in the master stocking portion 61. When the printer 1 reaches the stand-by state after the master discharging operation, the master 65 is conveyed toward a position between the stage 19*a* and the damper 19*b* by the turn roller pair 63. Subsequently, the print drum 12 is intermittently driven as in the simplex print mode, so that the master 65 is wrapped around the print drum 12. After the image data has been fully output from the image memory 135, the cutting means 60 is operated to cut off the master 65. The master 65 is then pulled out of the master making section 3 by the rotation of the print drum 12. Subsequently, the print drum 12 is brought to a stop at the home position, completing the master making and feeding operations. During the rotation of the print drum 12 at the time of the master feeding operation mentioned above, the path selector 10 is held in the first position.

The master feeding operation is followed by the master sticking operation. More specifically, when the print drum 12 stops at the home position, the stepping motor 52 is driven to rotate the stepped cam 49 while the press roller locking means is operated to cause the cam portion 49*a* to contact the cam follower 48*c*. As a result, the arm 48 is angularly moved about the shaft 48*a* to move the cam shaft 44 to the position where the cam plate 43B is capable of contacting the cam follower 41. Thereafter, the press roller locking means (not shown) stops operating.

Subsequently, the pickup roller 68, separator roller 69, drive rollers 36 and 87 and suction fans 39 and 90 are driven while the print drum 12 is rotated clockwise, as viewed in FIG. 1 at low speed. At the same time, the first sheet P is paid out from the feed tray 67 until its leading end has been nipped by the registration roller pair 71. After the damper 19*b* has moved away from the position corresponding to the path selector 10, the solenoid 123 is energized to move the path selector 10 to assume the second position. Thereafter, the stepping motor 142 is operated at a predetermined timing at which the leading end of the first perforated image 65A in the direction of rotation of the print drum 12 reaches the press roller 13, thereby driving the drive roller 71*a* to convey the first sheet P toward the position between the print drum 12 and the press roller 13.

At the above timing, the cam plate 43B capable of contacting the cam follower 41 causes its projection to move away from the cam follower 41 with the result that the press roller 13 is pressed against the print drum 12 due to the biasing force of the print pressure spring 42. It follows that the press roller 13, one side of the first sheet P, a first perforated image 65A of the master 65, and print drum 12 are pressed against each other. As a result, the ink supplied to the inner peripheral surface of the print drum by the ink roller 16 exudes from the opening portions of the print drum 12 and filled into the porous support plate (not shown) wrapped around the print drum 12, the mesh screen (not shown), and the porous support of the master 65, before being transferred to the one side of the first sheet P through the perforation of the first perforated image 65A. In this manner, part of the master 65 where the first perforated image 65A is present is stuck to the print drum 12.

The first sheet P, which has now become the front-side-printed sheet PA after having its one side printed with an image corresponding to the first perforated image 65A, is steered by the path selector 10 held in the second position toward the refeeding means 9 while being sequentially peeled off from the master 65 on the print drum from its one end.

The front-side-printed sheet PA, which has been steered downward by the path selector 10, passes between the guide plates 27 and 56 so that its one end comes into abutment against the sheet receiving plate 40 held in the first position as shown in FIG. 4. Then, the sheet receiving plate 40, which moves in synchronism with the rotations of the print drum 12 and the press roller 13 rotated while in press contact with the print drum 12, assumes the second position shown in FIG. 5, causing one end of the sheet PA to abut against the end fence 8*a* and the other end thereof to contact the auxiliary tray 8.

The front-side-printed sheet PA, having its other end held in contact with the auxiliary tray 8, is conveyed in the direction of the arrow of FIG. 1 while being retained on the endless belt 38 due to the sucking force of the suction fan 39, to abut against the refeed positioning member 24 at its other end. At this time, the sensor 8*c* detects the other end of the front-side-printed sheet PA, and a detection signal from the sensor 8*c* is output to the control means 129. Accordingly, a command is issued from the control means 129 to stop the operations of the drive roller 36 and the suction fan 39.

Even when the first sheet P is being guided on the auxiliary tray 8, the print drum 12 is continuously rotated. The press roller 13, after completing its contact with the front zone of the print drum 12, is released from the print drum 12 because the cam follower 41 rides over the projection of the cam plate 43B. The cam plate 43B prevents the reverse zone of the print drum 12 and the press roller 13 from contacting each other without the intermediary of the first sheet P, so that the transfer of the ink to the press roller 13 is obviated. At this instant, the press roller locking means (not shown) is operated to lock the press roller 13 at the released position. Subsequently, the stepping motor 52 is driven to rotate the stepped cam 49 until the cam portion 49*b* contacts the cam follower 48*c*. As a result, the arm 48 is angularly moved about the shaft 48*a* to move the camshaft 44 to the position where the cam plate 43A is capable of contacting the cam follower 41.

At substantially the same time as the above operation, the pickup roller 68 and separator roller 69 are driven to feed the second sheet P on the tray 67 and a leading end of the second sheet P is nipped with the registration roller pair 71. The stepping motor 142 is operated at the previously stated predetermined timing to cause the drive roller 71*a* to rotate, thereby conveying the second sheet P to the position between the print drum 12 and the press roller 13.

On the other hand, in the press roller moving mechanism 55, when the cam shaft 44 is rotated to a position where the projection of the cam plate 43A that has been moved is capable of contacting the cam follower 41, the press roller locking means (not shown) stops operating. At this instant, the print drum 12, rotating in synchronism with the cam shaft 44, faces the press roller 13 at its non-porous zone other than the front zone, reverse zone and intermediate zone. Also, the solenoid 123 is energized between the time when the front zone of the print drum 12 moves away from the press roller 13 and the time when the damper 19*b* again faces the path selector 10, moving the path selector 10 from the second position to the first position.

At the predetermined timing at which the registration roller pair 71 starts conveying the second sheet P, the projection of the cam plate 34A is released from the cam follower 41, with the result that the press roller 13 is pressed against the print drum 12 due to the biasing force of the print pressure spring 42. More specifically, the press roller 13, one side of the second sheet P, the first perforated image 65A of the master 65, and the print drum 12 are pressed against each other. As a result, the ink supplied to the inner peripheral surface of the print drum 12 by the ink roller 16 is transferred to the one side of the second sheet P through the opening portions of the print drum 12, the porous support plate and the mesh screen (both are not shown), and the perforation of the first perforated image 65A.

The second sheet P, which has now become the printed sheet PB after having its one side printed with the image corresponding to the first perforated image 65A, is steered by the path selector 10 held in the first position toward the sheet conveying member 85 while being peeled off from the master 65 on the print drum by the peeler 84 from its one end. The printed sheet PB thus peeled off drops onto the sheet conveying member 85 and conveyed to the print tray 86 thereby.

After the registration roller pair 71 has conveyed the second sheet P, the solenoid 33 is energized at a predetermined timing slightly earlier than the time when the leading end of the second perforated image 65B of the master 65 in the direction of rotation of the print drum 12 faces the press roller 13, causing the arm 32 to move clockwise, as viewed in FIG. 2, about the shaft 32*a*. Consequently, the refeed registration roller 23 is angularly moved from the released position to the contact position and causes the front-side-printed sheet PA, which has been retained in position with its other end abutting against the refeed positioning member 24, to abut against the press roller 13 that is being rotated by the print drum 12 in press contact therewith.

The front-side-printed sheet PA, which is brought into contact with the press roller 13 by the refeed registration roller 23, is conveyed by the press roller 13 to the downstream side in the direction of rotation of the press roller 13. The front-side-printed sheet PA is then conveyed by the refeed guide means 22 toward the nip between the print drum 12 and the press drum 13 in close contact with the press roller 13.

Although the front-side-printed sheet PA carries the image corresponding to the first perforated image 65A on its one side, the refeed guide means 22 maintains the front-side-printed sheet PA in close contact with the press roller 13. Therefore, the front-side-printed sheet PA, contacting the press roller 13, is prevented from being shifted, so that image defects including stain by friction and line thickening are obviated. After the trailing end and intermediate zone of the second sheet P have moved away from the position corresponding to the press roller 13, the front-side-printed sheet PA is brought to the nip between the print drum 12 and the press roller 13 at the timing at which the leading end of the reverse zone faces the press roller 13.

Consequently, the press roller 13, the other side of the front-side-printed sheet PA, the second perforated image 65B of the master 65, and the print drum 12 are pressed against each other. As a result, the ink supplied to the inner peripheral surface of the print drum 12 by the ink roller 16 is transferred to the other side of the front-side-printed sheet PA through the opening portions of the print drum 12, the porous support plate and the mesh screen (both are not shown), and the perforation of the second perforated image 65B. In this way, the portion of the master 65 formed with the second perforated image 65B is stuck to the print drum 12.

The first sheet P, which has now become the printed sheet PB after having its one side and the other side printed with the image corresponding to the first perforated image 65A and the image corresponding to the second perforated image 65B, respectively, is steered by the path selector 10 held in the first position toward the sheet conveying member 85 while being peeled off from the master 65 on the print drum from its one end. The printed sheet PB thus peeled off drops downward and conveyed by the sheet conveying member 85 to the print tray 86, thus completing the sticking operation of the master 65. The printer 1 then waits in the stand-by state.

Trial printing is performed when, in the stand-by state of the printer 1, the operator inputs desired printing conditions on the print speed key 113 and other various keys on the operation panel 103 and then presses the trial print key 106. When the trial printing key 106 is thus pressed, too, the control means 129 causes the LCD 120 to display a message urging the operator to set the sheet thickness; if "thick sheet" is set, the input on the trial printing key 106 is invalidated, and the control means 129 causes the LCD 120 to display a warning message urging the operator to set correct sheets.

When the trial print key 106 is pressed, the cam shaft 44 is moved to the position where the cam plate 43B is capable of contacting the cam follower 41 as during the master sticking operation. Subsequently, the print drum 12 is driven at an input print speed while the path selector 10 is switched to the second position as during the master sticking operation. After the start of rotation of the print drum 12, the first sheet P is fed from the sheet feeding section 4 and temporarily stopped and retained by the registration roller pair 71. The first sheet P thus fed is then conveyed by the registration roller pair 71 at the same timing as during the master sticking operation and pressed against the first perforated image 65A of the master 65 by the press roller 13.

The first sheet P, which has now become the front-side-printed sheet PA after having its one side printed with an image corresponding to the first perforated image 65A, is steered by the path selector 10 assuming the second position toward the sheet receiving plate 40 assuming the first position, while being peeled off from the master 65 on the print drum. When the sheet receiving plate 40 moves to the second position, one end of the front-side-printed sheet PA, which has been thus conveyed onto the sheet receiving plate 40, is brought into abutment against the end fence 8*a* while the other end of the sheet PA comes into contact with the endless belt 38. Subsequently, while being retained onto the belt 38 due to the suction force of the suction fan 39, the sheet PA is stooped and retained in position with its other end abutting the refeed positioning member 24.

Subsequently, the press roller locking means (not shown) is operated to lock the press roller 13 in the released position while the stepped cam 49 is rotated to shift the cam shaft 44 to the position where the cam plate 43A is capable of contacting the cam follower 41. The press roller locking means (not shown) then stops operation. The path selector 10 is switched from the second position to the first position immediately before the front zone of the print drum 12 passes a position where the print drum 12 faces the press roller 13. At substantially the same time, the second sheet P is fed from the sheet feeding section 4, temporarily stopped at the registration roller pair 71, and then conveyed by the registration roller pair 71 toward the printing section 2 at the same timing as the first sheet P.

In the printing section 2, the press roller 13 presses the second sheet P thus fed against the first perforated image 65A of the master 65 to thereby print an image corresponding to the first perforated image 65A on one side of the second sheet P. The second sheet P which has thus become the printed sheet PB is steered by the path selector 10 held in the first position toward the sheet conveying member 85. The printed sheet PB is peeled off from the master 65 by the peeler 84 and drops downward onto the sheet conveying member 85. The sheet conveying member 85 conveys the second sheet P to the print tray 86.

After the registration roller pair 71 has conveyed the second sheet P, the solenoid 33 is energized at the same timing as during the master sticking operation in order to move the refeed registration roller 23 from the released position to the contact position. As a result, the front-side-printed sheet PA, which has been temporarily retained on the auxiliary tray 8, is pressed against the press roller 13 in rotation. The sheet PA is therefore conveyed toward the printing section 2 due to the rotation of the press roller 13 that is being rotated in contact with the print drum 12.

The press roller 13 presses the front-side-printed sheet PA against the second perforated image 65B of the master 65, so that an image corresponding to the second perforated image 65B is transferred onto the other side of the sheet PA. The first sheet P, which has now become the printed sheet PB after having its both sides printed with images corresponding to the perforated images 65A and 65B, is steered by the path selector 10 held in the first position toward the sheet conveying member 85. Subsequently, the printed sheet PB is peeled off from the master 65 by the peeler 84 and then discharged to the print tray 86 by the sheet conveying member 85. This is the end of the trial printing operation.

Assume that the operator, confirmed the position, density and so forth of the images formed by trial printing, inputs a desired number of prints on the numeral keys 109, and then presses the print start key 105. In response, the printing operation begins. When the print start key 105 is thus pressed, too, the control means 129 causes the LCD 120 to display a message urging the operator to set the sheet thickness; if "thick sheet" is set, the input on the print start key 105 is invalidated, and the control means 129 causes the LCD 120 to display a warning message urging the operator to set correct sheets. In the illustrative embodiment, the desired number of prints is assumed to be N.

When the print start key 105 is pressed, the cam shaft 44 is moved to the position where the cam plate 43B is capable of contacting the cam follower 41 as during the master sticking operation and trial printing operation. Subsequently, the print drum 12 is driven at a peripheral speed corresponding to the desired printing speed while the path selector 10 is switched to the second position as during the master sticking operation and trial printing operation. After the start of rotation of the print drum 12, the first sheet P is fed from the sheet feeding section 4 to the registration roller pair 71. After being temporarily stopped at the registration roller pair 71, the first sheet P is then conveyed by the registration roller pair 71 at the same timing as during the trial printing operation. The first sheet P is then pressed against the first perforated image 65A of the master 65 by the press roller 13 so that an image corresponding to the first perforated image 65A is printed onto one side of the first sheet P, thus producing the first front-side-printed sheet PA.

The front-side-printed sheet PA is guided by means of the path selector 10 held in the second position while being peeled off from the outer peripheral surface of the print drum 12, causing its one end to abut against the sheet receiving plate 40 that is assuming the first position. Then, the sheet receiving plate 40 assumes the second position, whereby one end of the front-side-printed sheet PA abuts against the end fence 8*a* while its other end is brought into contact with the auxiliary tray 8. The front-side-printed sheet PA conveyed by each endless belt 38 on the auxiliary tray 8 is stopped and retained in position with its other end abutting the refeed positioning member 24.

Subsequently, the press roller locking means (not shown) is operated to lock the press roller 13 in the released position while the cam shaft 44 is shifted to the position where the cam plate 43A is capable of contacting the cam follower 41. The press roller locking means (not shown) then stops operating. At substantially the same time, the second sheet P is fed from the sheet feeding section 4, temporarily stopped by the registration roller pair 71, and then conveyed toward the printing section 2 at the same timing as the first sheet P. The path selector 10 is switched to the first position so as to avoid interference of the damper 19*b* with the path selector 10 and again switched to the second position after the passage of the damper 19*b*.

The second sheet P thus conveyed is then pressed against the first perforated image 65A of the master 65 by the press roller 13, so that the second sheet P becomes the second front-side-printed sheet PA after having its one side printed with an image corresponding to the first perforated image 65A. Thereafter, the sheet PA is steered by the path selector 10 held in the second position while being peeled off, and then conveyed toward the auxiliary tray 8 via the sheet receiving plate 40 held in the first position. At this instant, the solenoid 33 is energized at the same timing as during the trial printing operation and causes the first front-side-printed sheet PA staying on the auxiliary tray 8 to be conveyed toward the printing section 2 by the rotation of the press roller 13.

During the conveyance of the second front-side-printed sheet PA toward the auxiliary tray 8, one end of the second front-side-printed sheet PA is prevented from contacting the one end side of the first front-side-printed sheet PA due to the action of the sheet receiving plate 40. It is thus possible to prevent the one end portion and the reverse side of the second front-side-printed sheet PA from being stained by friction, and also prevent the one end side of the first front-side-printed sheet PA from stained by friction, which occur when the first and second front-side-printed sheets contact each other.

One end of the second front-side-printed sheet PA must be conveyed leftward as seen in FIG. 4 at this time. However, if there is no sheet receiving plate 40, the one end of the second front-side-printed sheet PA comes into contact with one end of the first front-side-printed sheet that is conveyed rightward in FIG. 4, and the force with which the second front-side-printed sheet PA is conveyed leftward in FIG. 4 is cancelled by the adhesion force of the ink on the first front-side-printed sheet PA and by the conveying force acting in the rightward direction of FIG. 4, causing the second front-side-printed sheet PA to stop at that position to generate a conveyance jam.

The second front-side-printed sheet PA sent out thereafter drops directly onto the auxiliary tray 8. At this point, no sheet is stacked on the auxiliary tray 8 because the first front-side-printed sheet PA has already left the auxiliary tray 8 as it is conveyed. Hence, the second front-side-printed sheet PA is sucked onto the auxiliary tray 8 due to the sucking force of the suction fan 39 that is operating, and also the conveying force acting thereon in the leftward direction in FIG. 4 is cancelled by the friction force of the endless belt 38, impeding smooth conveyance of the second front-side-printed sheet PA to generate a conveyance jam.

Such problems can be prevented by providing the sheet receiving plate 40 to receive one end of the front-side-printed sheet PA conveyed from the printing section 2, thereby allowing a smooth printing operation to be performed continuously.

After the trailing end of the second front-side-printed sheet PA has moved away from the nip between the press roller 13 and the print drum 12, the first front-side-printed sheet PA is conveyed to the above nip at the timing at which the reverse zone of the print drum 12 faces the press roller 13 after the intermediate zone of the print drum 12 passes the position where it faces the press roller 13. The first front-side-printed sheet PA is then pressed against the second perforated image 65B of the master 65 by the press roller 13, so that an image corresponding to the second perforated image 65B is printed on the other side of the first front-side-printed sheet PA, thus obtaining the printed sheet PB.

During the above operation, just before the intermediate zone of the print drum 12 faces the press roller 13, the path selector 10 is switched from the second position to the first position. Consequently, the other end of the second front-side-printed sheet PA being guided by the path selector 10 is discharged to the auxiliary tray 8 through the sheet receiving plate 40 via a small gap between the bottom 10*a* of the path selector 10 and the press roller 13. One end of the first printed sheet PB conveyed following this is steered toward the sheet conveying member 85 along the top 10*b* of the path selector 10. The first printed sheet PB is peeled off from the master 65 by the peeler 84 and then conveyed to the print tray 86 by the sheet conveying member 85.

Subsequently, the third sheet P is fed from the sheet feeding section 4, temporarily stopped by the registration roller pair 71, and then conveyed toward the printing section 2 at the same timing as the first sheet P and the second sheet P. The path selector 10 again assumes the second position after passage of the damper 19*b*. After an image corresponding to the first perforated image 65A has been printed on one side of the third sheet P so that the third sheet P becomes the front-side-printed sheet PA, the sheet PA is steered by the path selector 10 held in the second position toward the auxiliary tray 8 through the sheet receiving plate 40. Subsequently, the solenoid 33 is energized at the predetermined timing to convey the second front-side-printed sheet PA staying on the auxiliary tray 8 toward the printing section 2.

The second front-side-printed sheet PA reaches the nip between the print drum 12 and the press roller 13 at the same timing as the first front-side-printed sheet PA, so that an image corresponding to the second perforated image 65B is printed on the other side of the second front-side-printed sheet PA, thus obtaining the second printed sheet PB. The path selector 10 is switched from the second position to the first position at the previously stated timing to thereby steer the other end of the third front-side-printed sheet PA toward the auxiliary tray 8 via the small gap between the bottom 10*a* of the path selector 10 and the press roller 13 and through the sheet receiving plate 40.

Thereafter, one end of the second printed sheet PB conveyed from the auxiliary tray 8 is steered toward the sheet conveying member 85 along the top 10*b* of the path selector 10. The second printed sheet PB is then peeled off from the master 65 by the peeler 84 and conveyed to the print tray 86 by the sheet conveying member 85.

The printing procedure described above is repeated up to the (N−1)-th print. The N-th sheet P is fed from the sheet feeding section 4, formed with an image corresponding to the first perforated image 65A on its one side, and then guided to the auxiliary tray 8 as the N-th front-side-printed sheet PA through the sheet receiving plate 40. Subsequently, the (N−1)-th front-side-printed sheet PA is formed with an image corresponding to the second perforated image on its other side and then discharged to the print tray 86 as the (N−1)-th printed sheet PB. Thereafter, the press roller locking means (not shown) is operated to lock the press roller 13 at the released position while the cam shaft 44 is shifted to the position where the cam plate 43C is capable of contacting the cam follower 41. At this time, the press roller locking means (not shown) stops operating with the path selector 10 remaining in the first position.

At a first timing earlier than the time when the leading end of the second perforated image 65B in the direction of drum rotation of the master 65 arrives at the press roller 13, the cam plate 43C moved to the position where the cam shaft 43C is capable of contacting the cam follower 41 has its projection released from the cam follower 41. As a result, the press roller 13 is pressed against the print drum 12 due to the biasing force of the print pressure spring 42.

Subsequently, the solenoid 33 is energized at a second timing slightly earlier than the time when the leading end of the second perforated image 65B in the direction of drum rotation of the master 65 arrives at the press roller 13. Consequently, the refeed registration roller 23 is shifted from the released position to the contact position, so that the N-th front-side-printed sheet PA, which has been retained in position with its other end abutting the refeed positioning member 24, is conveyed to the printing section 2 due to the rotation of the press roller 13 rotated in contact with the print drum 12.

The N-th front-side-printed sheet PA is conveyed to the nip between the print drum 12 and the press roller 13 at the same timing as the first front-side-printed sheet PA, so that an image corresponding to the second perforated image 65B is printed on the other side of the N-th front-side-printed sheet PA, thus obtaining the N-th printed sheet PB. The N-th printed sheet PB is then guided along the top 10*b* of the path selector 10 to the sheet discharging section 6, peeled off from the master 65 by the peeler 84, and conveyed to the print tray 86 by the sheet conveying member 85.

Subsequently, as the cam follower 41 rides over the projection of the cam plate 43C, the press roller 13 contacting the reverse zone of the print drum 12 is released from the print drum 12. This action of the cam plate 43C prevents the front zone of the print drum 12 and the press roller 13 from contacting each other without the intermediary of the sheet P and thereby obviates the transfer of ink to the press roller 13. At this instant, the press roller locking means (not shown) is operated to lock the press roller 13 at the released position, and then the print drum 12 is brought to a stop at the home position. The printer 1 thus completed the printing operation again waits in the stand-by position.

According to the duplex printer 1 described above, at the time of duplex printing, the master 65 is formed with the first and second perforated images 65A and 65B by the master making section 3 and is wrapped around the print drum 12 while the front side of the first sheet P1 fed from the sheet feeding section 4 is pressed against the print drum 12 by the press roller 13, and then the first sheet P1 is discharged to the auxiliary tray 8. Subsequently, the second sheet P2 is fed from the sheet feeding section 4, has its front side pressed against the print drum 12 by the press roller 13, and is then discharged to the auxiliary tray 8. At the same time, the first sheet P1 is reversed and refed by the refeeding means 9, has its reverse side pressed against the print drum 12 by the press roller 13, and then discharged to the print tray 86. Therefore, images are formed on both sides of the sheet P by the ink transferred from the print drum 12 by the press roller 13, insuring an attractive duplex print.

Further, in the simplex print mode, the master 66 made by the master making section 3 is wrapped around the print drum 12 while the sheet P fed from the sheet feeding section 4 is pressed against the print drum 12 by the press roller 13. The simplex print mode can therefore be effected in the same manner as in a conventional stencil printer without wasting the master 64.

Furthermore, according to the duplex printer 1 described above, the printing section 2 includes the print drum 12 and the press roller 13 smaller in diameter than the print drum 12. This coupled with the fact that the auxiliary tray 8 is positioned below the sheet conveying member 85 constituting the sheet discharging section 6, prevents the printer 1 from becoming more bulky than the conventional stencil printer operable in the simplex print mode, thereby saving space to be occupied by the printer 1.

Now, a description is given of how positional adjustment is effected on a sheet P with respect to the first perforated image 65A and the second perforated image 65B during duplex printing with the duplex printer 1.

Figure 12:
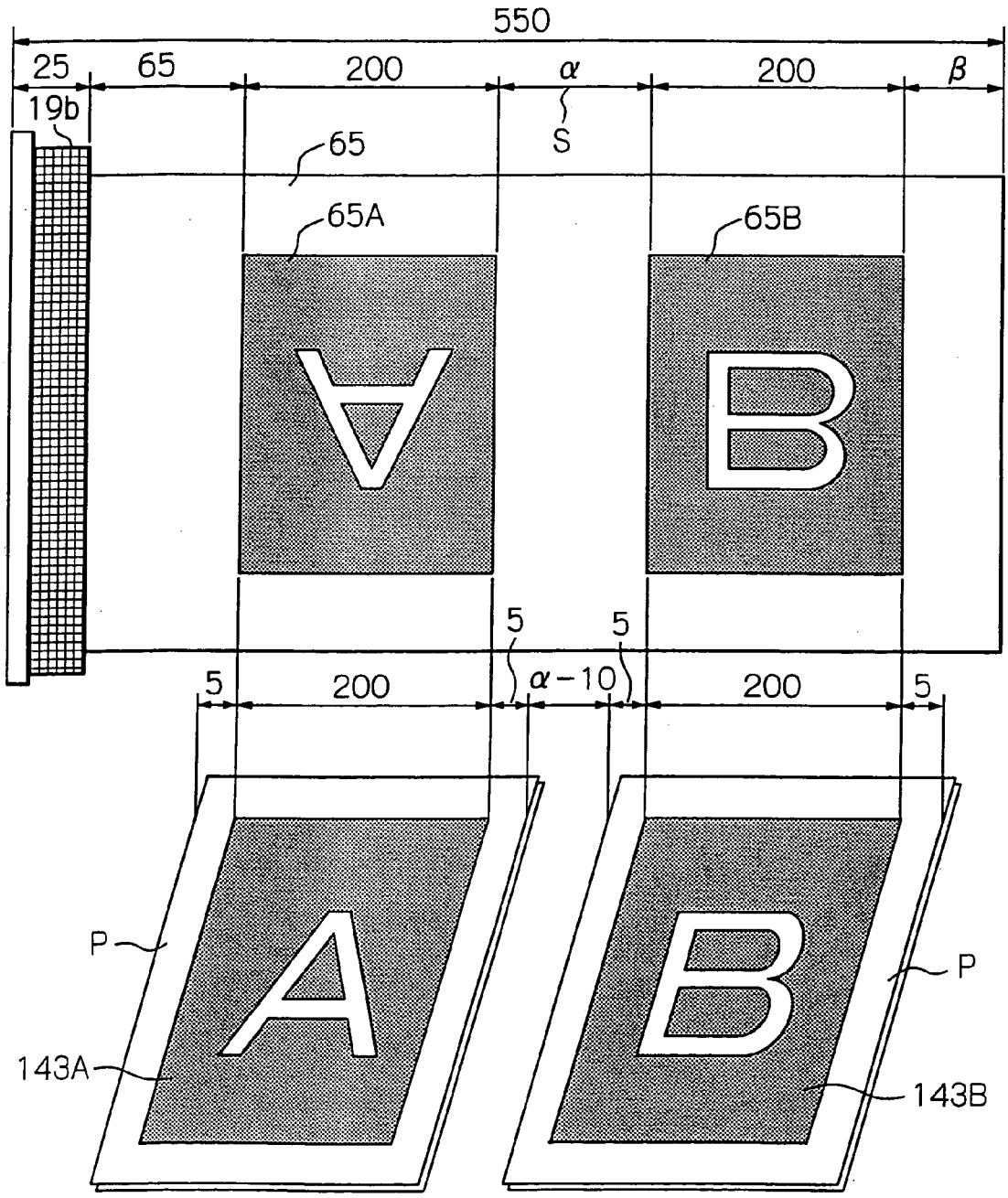
FIG. 12 is a view for explaining a positional relationship between the master with perforated images which is used in the duplex printer and sheets.

FIG. 12 shows an example of the master 65 with the first and second perforated images 65A and 65B which is made in the duplex printing mode, and the sheet P brought into contact with the master 65 to receive printing. In this example, the print drum 12 has a diameter of 180 mm, and the maximum total length of the master 65 is set to 550 mm. An A4 size sheet is used as the sheet P. A first print image 143A corresponding to the first perforated image 65A is formed on the front side of the sheet P, and a second print image 143B corresponding to the second perforated image 65B is formed on the reverse side thereof.

The distance from the leading end position of the master 65 to the master-making start position for the first perforated image 65A is necessary for allowing the press roller 13 to avoid interference with the damper 19*b*, and a specific value is set for each device. If the above distance is too short, the curve of the multiple-cum 43 necessary for causing angular movement of the press roller 13 needs to be made more steep, resulting in an increase in the speed of the angular movement of the press roller 13 which in turn increases the energy with which the press roller 13 collides with the outer peripheral surface of the print drum. As a result, the press roller 13 makes a bound at a position forward of the first perforated image 65A, and image dropouts or image unevenness can easily develop in the print images 143A and 143B that are to be transferred to the sheet P. Thus, some distance needs to be secured. Through an experiment, it was found that 80 to 100 mm is necessary as the distance, which in this example is set to 90 mm.

The width of the perforated images 65A and 65B is set to 200 mm, which is a value obtained by subtracting 5 mm, which is the width of the margin at either side end of the sheet P, from 210 mm that is the lateral width of the A4 size paper P. In addition, the blank portion S is provided for preventing two sheets P from overlapping with each other, and its width is set to $\alpha$. Further, provided on the right of the second perforated image 65B is a width $\beta$ for preventing ink from leaking through the hole portion of the print drum 12. While the width $\beta$ needs to be set on the order of 20 to 60 mm, this is not the case when it is desired to suppress the consumption of the master 64 by reducing the length of the master 65 without giving consideration to the ink leakage.

Figure 13:
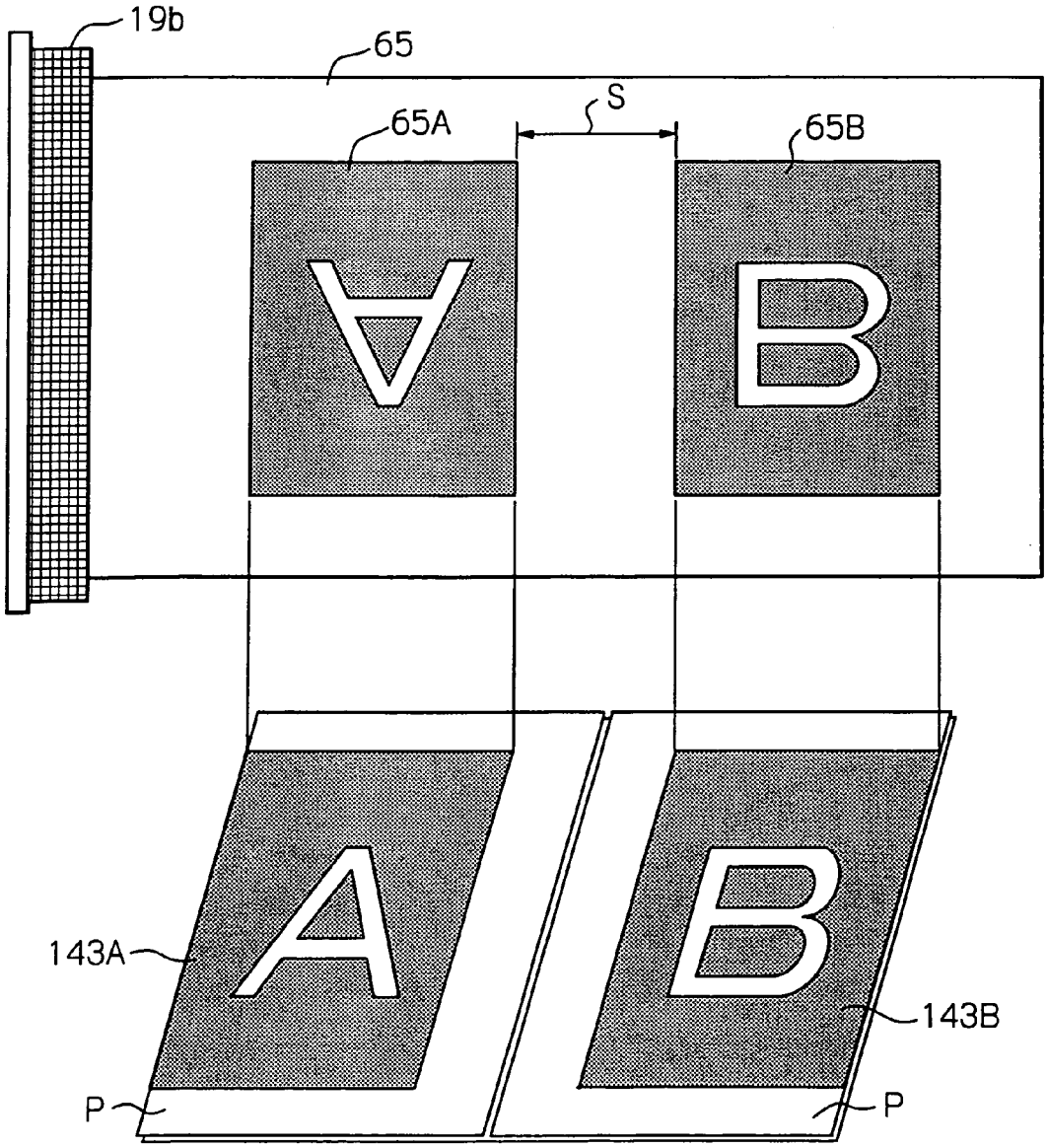
FIG. 13 and FIG. 14 are views for explaining how positional adjustment is effected on print images in a sheet conveyance direction.
Figure 14:
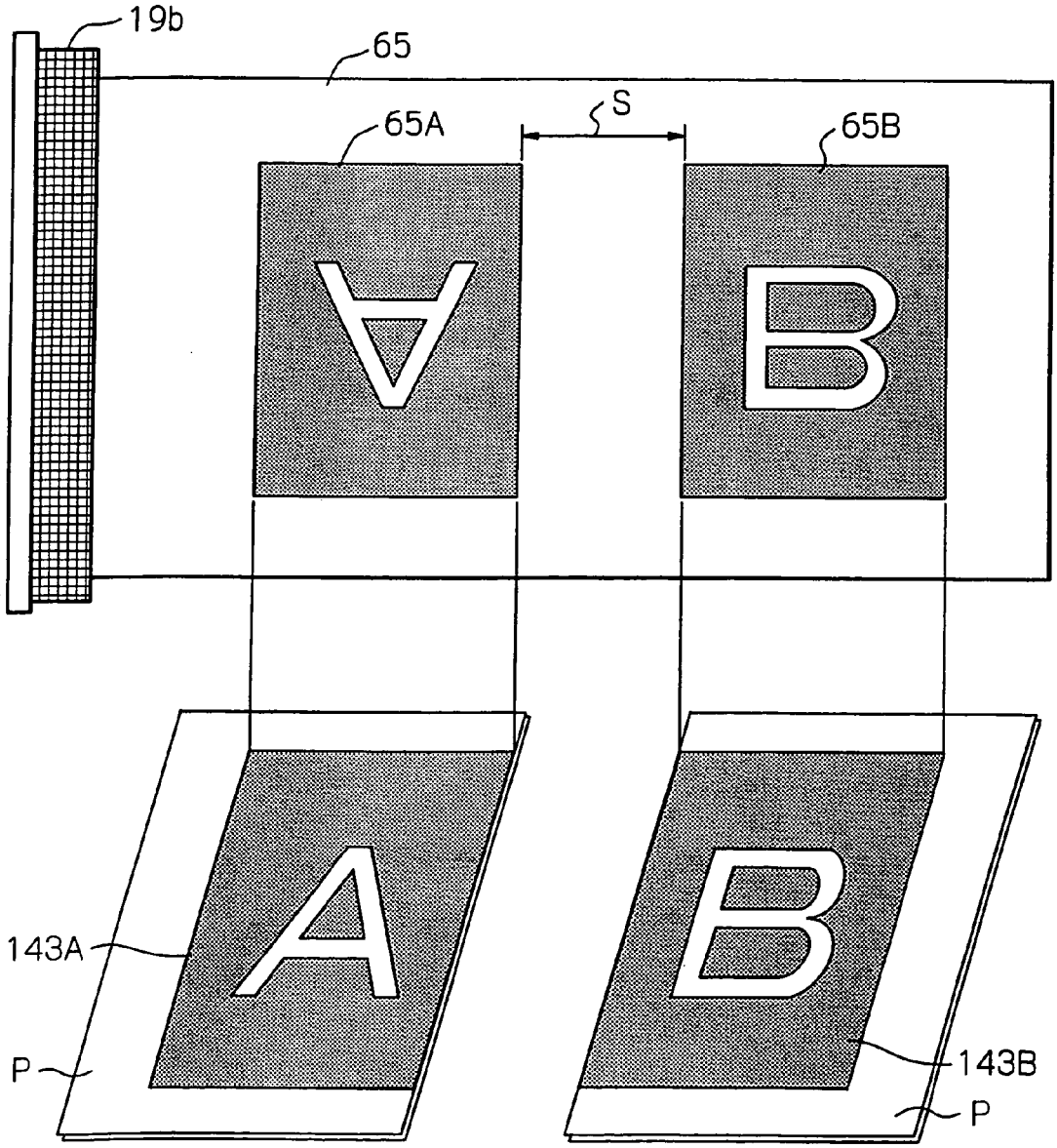

In the master 65 shown in FIG. 12, the width of the sheet P is 210 mm and the width of the margin at either side end of the sheet P is 5 mm. Thus, each of the print images 143A and 143B moves with respect to the sheet P between a position shown in FIG. 13 in which the printed images 143A and 143B are each displaced toward the binding margin side and a position shown in FIG. 14 in which the printed images 143A and 143B are each displaced toward the outside of the sheet (provided that left side binding is performed in either of the cases). Thus, the width $\alpha$ of the blank portion S required for preventing two sheets P from overlapping with each other is 20 mm at the minimum in the state shown in FIG. 13, whereas a minimum of 0 mm suffices in the state shown in FIG. 14. If the width $\alpha$ of the blank portion S is set to 20 mm in the state shown in FIG. 13, the length of the master 65 becomes a minimum of 510 mm, and if the width $\alpha$ of the blank portion S is set to 0 mm in the state shown I FIG. 14, the length of the master 65 becomes a minimum of 490 mm.

Next, description is made on the amounts of positional adjustment on the printed images 143A and 143B effected through setting operations on the duplex printer 1.

When the initial setting key 141 on the operation panel 103 is pressed, an image-position adjustment amount setting screen is displayed on the LCD 120. The operator sets the amount of adjustment on this screen for each of the printed images 143A and 143B by using the ten key 109, the 4-direction keys 114, etc., and the setting is confirmed by pressing the enter key 110. At this time, under the condition that the master 65 has a length set according to the diameter of the print drum 12, the amount of positional adjustment can be set to an arbitrary value between the minimum requisite length (490 mm in the above-mentioned case) of the master 65 in the case where the possible print-image-position moving amount determined in accordance with the sectional area of the images 65A and 65B is 0, and the maximum length (550 mm in the above-mentioned case) of the master 65 in the case where the necessary print-image-position movement amount is secured on the condition that the training end of the sheet P on which the first print image 143A is printed and the leading end of the sheet P on which the second print image 143B is formed do not overlap with each other.

When the print start key 105 is pressed after setting the amount of positional adjustment, the duplex printing operation is performed in the same manner as described above. At this time, based on the positional information of the print drum 12 which is obtained from the encoder (not shown), the control means 129 controls the operation timings of the stepping motor 142 and the solenoid 33 according to the set amount of positional adjustment, whereby a control is effected on the sheet P feeding timing so that each of the print images 143A and 143B is printed at a position corresponding to the set amount of positional adjustment.

By setting a somewhat small value for the above-mentioned position adjustment amount, the length of the master 64 can be made as small as possible under normal conditions, allowing a reduction in running cost. Further, by changing the position adjustment amount as required within the above-mentioned conditions so as not to exceed the maximum value thereof, an appropriate print-image-position movement amount can be secured as required in accordance with the size of the sheet P. Therefore, it is possible to obtain a satisfactory duplex print according to the needs of the user while preventing such problems as a print image failure, a sheet discharge failure, and breakage of the master which occur due to overlapping of sheets.

In the above-described embodiment, when, after making the master 65, an adjustment needs to be performed on the position of the first print image 143A at the time of duplex printing, such an adjustment is performed by inputting an amount of movement from the print-image standard position (the position shown in FIG. 12) in the sheet conveyance direction. When, for example, the position of the first print image 143A is to be moved to the upstream side in the sheet conveyance direction at this time (when it is to be moved in the same direction as that shown in FIG. 13), the operator makes an input as, for example, "+X mm" (X is an integer of 1 to 5)(as "−X mm" when it is to be moved to the downstream side in the sheet conveyance direction). The duplex printer may be configured to display the possible position-adjustment amount for the second print image 143B on the LCD 120 simultaneously with this input, and invalidate an input of a position adjustment amount exceeding the possible position-adjustment amount thus displayed. The possible position-adjustment amount for the second print image 143B is calculated from the preset position adjustment amount and the position adjustment amount for the first print image 143A.

This configuration makes it easier for the operator to keep track of the status of positional adjustment. In addition, with the configuration in which an input of a position adjustment amount exceeding the displayed possible position-adjustment amount is invalidated, it is possible to obtain a satisfactory duplex print according to the needs of the user while preventing such problems as a print image failure, a sheet discharge failure, and breakage of the master which occur due to overlapping of sheets.

Further, as a modification of the above-described configuration, a configuration may be adopted in which when the operator attempts to input a position adjustment amount that exceeds the displayed possible position-adjustment amount, first, a warning message stating "the possible image-position adjustment amount is exceeded" is displayed on the LCD 120, and when there is some room between the position adjustment amount set thereafter and the maximum value of the position adjustment amount, the position adjustment amount is automatically reset to the maximum value and a message stating "Master making must be performed again to expand the adjustment range" is displayed on the LCD 120, thus urging the operator to perform master making again. The operator performs the master making again if he judges, after checking the print output, that it is necessary to perform image-position adjustment in the sheet conveyance direction. When, at this time, the operator judges that there is no need to perform master making again, duplex printing within the image adjustment range becomes ready at that point.

When, after thus performing the master making again, the operator further attempts to input a position adjustment amount exceeding the possible position-adjustment amount, a warning message stating "the possible image-position adjustment amount is exceeded" is displayed on the LCD 120, warning the operator that any more image-position adjustment cannot be performed. After this process, at the time when the printing operation becomes complete and the master making operation using a new document is instructed anew, the position adjustment amount is automatically reset from the maximum value to the initial setting value.

This configuration makes it possible to obtain a satisfactory duplex print according to the needs of the user while preventing such problems as a print image failure, a sheet discharge failure, and breakage of the master which occur due to overlapping of sheets.

According to the present invention, during duplex printing, the front-side image and the reverse-side image to be printed onto the sheet are both formed with ink transferred from the print drum by the press roller, thereby making it possible to obtain a satisfactory duplex print. Further, during simplex printing, simplex printing can be performed in the same manner as in a conventional stencil printer without wasting the master. Moreover, it is possible to achieve a reduction in running cost, prevention of noise and vibrations, extended life spans of the press roller and the refeeding means, and prevention of ink transfer from the press roller to the refeeding means.

Further, the printing section is comprised of the print drum and the press roller having a smaller diameter than the print drum, and the auxiliary trays are positioned below the sheet discharging section, whereby the duplex printer can be constructed without a considerable increase in size as compared with the conventional stencil printer for simplex printing, making it possible to restrain an increase in installation space.

Further, positional adjustment can be effected on the print images in the sheet conveyance direction, whereby it is possible to obtain a satisfactory duplex print according to the needs of the user. The duplex printer is configured to invalidate an input of a position adjustment amount that exceeds the possible position-adjustment amount, whereby it is possible to obtain a satisfactory duplex print according to the needs of the user while preventing such problems as a print image failure, a sheet discharge failure, and breakage of the master which occur due to overlapping of sheets.

Various modifications will become possible for those skilled in the art after receiving the teachings of the present disclosure without departing from the scope thereof.

What is claimed is:

1. A duplex printer capable of switching between a simplex print mode and a duplex print mode, comprising:

a printing section including a print drum and a press roller, the press roller being provided so as be movable into or out of contact with the print drum;

a sheet feeding section for feeding a sheet toward the printing section;

a sheet discharging section for discharging to an outside of the printer a printed sheet on which printing has been performed in the printing section;

an auxiliary tray for temporarily retaining thereon a front-side-printed sheet having a print image formed on its front side in the printing section;

refeeding means for refeeding the front-side- printed sheet retained on the auxiliary tray toward the printing section; and a path selector for steering the sheet coming out of the printing section to either the auxiliary tray or the sheet discharging section, wherein, in the duplex print mode, a master having a first perforated image and a second perforated image formed thereon side by side, is wound around the print drum, and a first sheet is fed to the printing section from the sheet feeding section to print a first print image corresponding to the first perforated image on a front side of the first sheet, and after the first sheet having the first print image printed thereon is steered toward the auxiliary tray by the path selector, a second sheet is fed to the printing section from the sheet feeding section to print a first print image corresponding to the first perforated image on a front side of the second sheet while the refeeding means feeds the first sheet to the printing section again to thereby print a second print image corresponding to the second perforated image on a reverse side of the first sheet, and the first sheet and the second sheet are steered by the path selector toward the sheet discharging section and the auxiliary tray, respectively, and means for effecting position adjustment on each of the first and second print images with respect to each of the first and the second sheets in a sheet conveyance direction, with position adjustment on the first print image being effected by changing a sheet feeding timing of the sheet feeding section and position adjustment on the second print image being effected by changing a refeeding timing of the refeeding means.

2. The duplex printer as claimed in claim 1, wherein the means for effecting position adjustment includes a registration roller pair in the sheet feeding section for feeding the sheet toward the printing section, and a refeed registration member in the refeeding means for feeding the front-side-printed sheet toward the printing section again, and wherein a feeding timing and a refeeding timing for the sheet with respect to the printing section are changed by changing operation timings of the registration roller pair and the refeed registration member, respectively.

3. The duplex printer as claimed in claim 1, further comprising a master making section for making the master having the first and second perforated images, the master making section making, as the master having the first and second perforated images, a master having a non-image area formed between the first perforated image and the second perforated image, for preventing a trailing end of the second sheet printed with the first print image and a leading end of the first sheet printed with the second print image from overlapping with each other in the duplex print mode.

4. The duplex printer as claimed in claim 3, wherein the master making section forms the non-image area such that the non-image area has a width not smaller than one of a position adjustment amount of the first print image and a position adjustment amount of the second print image.

5. The duplex printer as claimed in claim 3, wherein the master making section forms the non-image area such that the non-image area has a width not smaller than the sum of a position adjustment amount of the first print image and a position adjustment amount of the second print image.

6. The duplex printer as claimed in claim 5, wherein the width of the non-image area can be set arbitrarily between a minimum width and a maximum width, the minimum width and the maximum width being set when the position adjustment amount of the first print image and the position adjustment amount of the second print image are 0 and a maximum value, respectively.

7. The duplex printer as claimed in claim 6, wherein, when a positional adjustment amount is input for one of the first print image and the second print image after the width of the non-image area is set, a position adjustment amount for the other of the first print image and the second print image is restricted so as not to exceed the set width of the non-image area.

8. The duplex printer as claimed in claim 6, wherein, after the width of the non-image area is set and a position adjustment amount is input for one of the first print image and the second print image, when a position adjustment amount is to be input for the other of the first print image and the second print image, a warning is issued if a value of the position adjustment amount to be input exceeds the width of the non-image area.

9. The duplex printer as claimed in claim 8, wherein when the warning is issued, if the set width of the non-image area is smaller than the maximum width, the width of the non-image area is reset to the maximum width and a message is displayed to urge an operator to perform master making again.

10. A duplex printer capable of switching between a simplex print mode and a duplex print mode, comprising:

a printing section including a print drum and a press roller, the press roller being provided so as be movable into or out of contact with the print drum;

a sheet feeding section for feeding a sheet toward the printing section;

a sheet discharging section for discharging to an outside of the printer a printed sheet on which printing has been performed in the printing section;

an auxiliary tray for temporarily retaining thereon a front-side-printed sheet having a print image formed on its front side in the printing section;

refeeding means for refeeding the front-side- printed sheet retained on the auxiliary tray toward the printing section; and a path selector for steering the sheet coming out of the printing section to either the auxiliary tray or the sheet discharging section, wherein, in the duplex print mode, a master having a first perforated image and a second perforated image formed thereon side by side, is wound around the print drum, and a first sheet is fed to the printing section from the sheet feeding section to print a first print image corresponding to the first perforated image on a front side of the first sheet, and after the first sheet having the first print image printed thereon is steered toward the auxiliary tray by the path selector, a second sheet is fed to the printing section from the sheet feeding section to print a first print image corresponding to the first perforated image on a front side of the second sheet while the refeeding means feeds the first sheet to the printing section again to thereby print a second print image corresponding to the second perforated image on a reverse side of the first sheet, and the first sheet and the second sheet are steered by the path selector toward the sheet discharging section and the auxiliary tray, respectively, a first timing adjuster for changing the sheet feeding timing of the sheet feeding section to permit position adjustment on the first print image, a second timing adjuster for changing the refeeding timing of the refeeding means to permit position adjustment on the second print image, and wherein the duplex printer is capable of effecting position adjustment on each of the first and second print images with respect to each of the first and the second sheets in a sheet conveyance direction.

* * * * *

UNITED STATES PATENT AND TRADEMARK OFFICE

CERTIFICATE OF CORRECTION

PATENT NO. : 7,188,564 B2
APPLICATION NO. : 10/799858
DATED : March 13, 2007
INVENTOR(S) : Atsushi Ashikagaya It is certified that error appears in the above-identified patent and that said Letters Patent is hereby corrected as shown below:

Column 15, line 56, change “damper” to --clamper--
Column 15, line 59, change “damper” to --clamper--
Column 19, line 21, change “damper” to --clamper--
Column 19, line 49, change “damper” to --clamper--
Column 20, line 51, space between “camshaft”

Signed and Sealed this

Fourth Day of December, 2007

JON W. DUDAS
*Director of the United States Patent and Trademark Office*